US006992285B1

(12) United States Patent
Cousins et al.

(10) Patent No.: US 6,992,285 B1
(45) Date of Patent: Jan. 31, 2006

(54) METHOD AND APPARATUS FOR ANALYZING A SUBSTANCE USING MS$^N$ ANALYSIS

(75) Inventors: Lisa Cousins, Toronto (CA); Bruce Thomson, Etobicoke (CA)

(73) Assignee: MDS Inc., Concord (CA)

( * ) Notice: Subject to any disclaimer, the term of this patent is extended or adjusted under 35 U.S.C. 154(b) by 73 days.

(21) Appl. No.: 09/592,436

(22) Filed: Jun. 12, 2000

(30) Foreign Application Priority Data

Jun. 10, 1999 (CA) ..... 2274186

(51) Int. Cl.
*H01J 49/00* (2006.01)
*H01J 49/42* (2006.01)

(52) U.S. Cl. ..... 250/292; 250/281; 250/282; 250/284; 250/288; 250/290

(58) Field of Classification Search ..... 250/281–288, 250/291, 292
See application file for complete search history.

(56) References Cited

U.S. PATENT DOCUMENTS

| | | | | |
|---|---|---|---|---|
| 5,420,425 A | | 5/1995 | Bier et al. | 250/292 |
| 5,763,878 A | * | 6/1998 | Franzen | 250/292 |
| 6,011,259 A | * | 1/2000 | Whitehouse et al. | 250/287 |
| 6,111,250 A | * | 8/2000 | Thomson et al. | 250/282 |

FOREIGN PATENT DOCUMENTS

| | | | |
|---|---|---|---|
| CA | 2236199 | 10/1999 | 49/26 |

OTHER PUBLICATIONS

R.E. March, R.J. Hughes, "*Quadrupole Storage Mass Spectrometry*", 1989, John Wiley & Sons, pp. 365–387.

* cited by examiner

*Primary Examiner*—John R. Lee
*Assistant Examiner*—David A. Vanore
(74) *Attorney, Agent, or Firm*—Bereskin & Parr

(57) ABSTRACT

A method of and apparatus for analyzing a substance takes a stream of ions in said substance and supplies the ions to a collision cell including a quadrupole rod set for guiding the ions and a buffer gas. An RF voltage is applied to the quadrupole rod set to guide ions. An additional alternating current signal is applied to the quadrupole rod set at a frequency selected to cause resonance excitation of the secular frequency of a desired ion, whereby said desired ions are excited and undergo collision with the buffer gas causing fragmentation. The alternating current signal is then modulated, whereby periods in which said alternating current signal is applied alternate with periods in which said alternating signal is not applied. The ion spectrum after fragmentation is collected to generate one set of data for one spectrum, representative of the ion spectrum when the alternating current signal is applied, and another set of data for another spectrum, representative of the ion spectrum when the alternating current signal is not applied. These two spectra can then be subtracted.

30 Claims, 17 Drawing Sheets

METHOD AND APPARATUS FOR ANALYZING A SUBSTANCE USING $MS^N$ ANALYSIS

FIELD OF THE INVENTION

This invention relates mass spectrometers, and more particularly is concerned with collision-induced dissociation (CID) in a tandem mass spectrometer. The invention is particularly intended to enable multiple stages of fragmentation, and hence mass analysis or spectroscopy, to be effected in a collision cell.

BACKGROUND OF THE INVENTION

Radio frequency (RF) only multipole spectrometers, more particularly quadrupole spectrometers, are widely applied in mass spectrometry and nuclear physics, due to their ability to transport ions with minimal losses. During such transportation of the ions, the initial ion positions and velocities change, but the total phase space volume occupied by the ion beam remains constant (see Dawson, P. H., "Quadrupole Mass Spectrometry and its Applications," Elsevier Scientific Publishing Co., New York, 1976). However, if a buffer gas is introduced into the ion guide, a dissipative process occurs, due to ion molecule collisions, and this enables an ion beam to be focused onto the quadrupole axis after the initial velocities have been damped.

Collisional quadrupole or other multipole devices have been used as an ion guide providing an interface between an ion source and a mass spectrometer, or alternatively as a collision cell for collision-induced dissociation (CID) experiments. As a straightforward interface, collisional damping reduces the space and velocity distributions of the ions leaving the ion source, thus improving the beam quality. For CID experiments, primary ions having relatively large velocities enter the multipole and collide with buffer gas molecules, and so collision-induced dissociation takes place. The multipole helps to keep both primary ions and fragment ions, resulting from the collision-induced dissociation, close to the axis and to deliver them to the exit for further analysis. Collisions inside the multipole spectrometer again act to reduce the space and velocity distribution of the ion beam.

Ion motion in a perfect quadrupole field is governed by Mathieu's equation (See Dawson as cited above); ions oscillate around the quadrupole axis at an appropriate fundamental frequency which is determined by their m/z and quadrupole parameters, and is independent of ion position and velocity. If the frequency of any periodic forces acting on ions coincides with the ion fundamental frequency, then resonance excitation takes place. Similar resonance excitation is widely applied in quadrupole ion trap or in ion cyclotron resonance mass spectrometers (R. E. March, R. J. Hughes, "Quadrupole storage mass spectrometry," 1989, John Wiley & Sons).

These properties of spectrometers have been employed in many ways. Thus, in U.S. provisional patent application 60/046,926 filed May 16, 1997 (and related U.S. patent application Ser. No. 09/066,556 and Canadian patent application 2,236,199), there is disclosed a high pressure MS-MS system. This was intended to provide improvements to a conventional triple quadrupole mass spectrometer arrangement, employing two precision quadrupole mass spectrometers separated by an RF-only quadrupole which is operated as a gas collision cell. The first mass spectrometer is used to select a specific ion mass-to-charge ratio (m/z), and to transmit the selected ions into the RF-only quadrupole or collision cell. In the RF-only quadrupole collision cell, some or all of the parent ions are fragmented by collisions with the background gas, commonly argon or nitrogen, at a pressure of up to several millitorr. The fragment ions, along with any unfragmented parent ions are then transmitted into the second precision-quadrupole which is operated in a mass resolving mode. Usually, the mass resolving mode of this second spectrometer is set to scan over a specified mass range, or else to transmit selected ion fragments by peak hopping, i.e. by being rapidly adjusted to select specific ion m/z ratios in sequence. The ions transmitted through this spectrometer are detected by an ion detector. A problem with this conventional arrangement is that the two mass resolving quadrupoles are required to operate in the high vacuum region (less than $10^{-5}$ torr), while the intermediate collision cell operates at a pressure up to several millitorr. That earlier invention was intended to simplify the apparatus and eliminate the necessity for separate RF-only and resolving spectrometers at the input to the apparatus. Instead, a single quadrupole is provided, operating in the RF-mode to act as a high pass filter. Additionally, this quadrupole is provided with an AC field, which can be identified as a "filtered noise field", which contains a notch in the frequency range corresponding to the mass of an ion of interest. This notch can be moved, to select and separate desired ions.

Other older proposals can be found, for example, in U.S. Pat. No. 5,420,425 (Bier et al. and assigned to Finnigan Corporation). This relates to an ion trap mass spectrometer, for analyzing ions. It has electrodes shaped to promote an enlarged ion occupied volume. A quadrupole field is provided to trap ions within a predetermined range of mass to charge ratios. Then, the quadrupole field is changed so that trapped ions with specific masses become unstable and leave the trapping chamber in a direction orthogonal to the central axis of the chamber. The ions leaving the spectrometer are detected, to provide a signal indicative of their mass-to-charge ratios. One method that is taught in this patent is to first introduce ions within a predetermined range of mass-to-charge ratios into the chamber and subsequently to change the field to select just some ions for further manipulation. The quadrupole field is then adjusted so as to be capable of trapping product ions of the remaining ions, and the remaining ions are then dissociated or reacted with a neutral gas to form those product ions. Subsequently, the quadrupole field is changed again, to remove, for detection, ions whose mass-to-charge ratios lie within the desired range, which ions are then detected.

The above process describes how the technique of MS/MS (or $MS^2$) is applied in an ion trap configuration. A related technique of MS/MS/MS (or $MS^3$) can be provided by isolating one of the product ions of the first $MS^2$ process, and eliminating all but the selected product ion from the trap. The selected product ion mass is then excited so that it fragments through collisions with the buffer gas in the trap. The range of secondary product ions formed in this two-stage process is then scanned from the trap for detection, so that a mass spectrum is recorded. The spectrum consists of fragments of a fragment from the original parent ion. The process can be extended by trapping and isolating one of the secondary product ions, and then fragmenting that ion mass, in order to form an MS/MS/MS/MS or $MS^4$ spectrum, and ultimately the process can be extended to an $MS^n$ spectrum. Ion losses occur at each stage, however, so that sensitivity decreases as the number of steps increases. Nevertheless, this technique of $MS^n$ can be a useful tool to help elucidate the structure of organic ions.

Another approach to obtaining an $MS^3$ spectrum is described in U.S. Pat. No. 6,011,259 by Craig Whitehouse, Thomas Dresch and Bruce Andrien of Analytica of Brantford, which shows how a multipole ion guide can be combined with a time-of-flight (TOF) mass spectrometer to provide $MS^n$ analysis. They describe the method of using resonant excitation to excite one ion mass in the quadrupole ion guide in order to fragment a selected ion (without isolating or rejecting the other ion masses). By turning the excitation on and off several times per second, a background subtracted spectrum of the fragments of the desired precursor ion can be created. This works very well with TOF mass spectrometers where the TOF is pulsed at a higher frequency than the pulsing of the excitation.

The method described produces an $MS^2$ spectrum of the selected ion. In order to produce an $MS^3$ spectrum (designated by the inventors of that patent as $MS/MS^2$), two frequencies must be added, first exciting just the first precursor ion, then adding another frequency to excite both the first precursor ion and the selected product of that precursor ion together, and subtracting the spectra to obtain an $MS^3$ spectrum. A total of three spectra must be collected sequentially: a first spectrum without any excitation, then a spectrum with only one excitation frequency (first $MS^2$ spectrum), then a spectrum with both frequencies added simultaneously ($MS^3$). The second spectrum must be subtracted from the first spectrum in order to generate the $MS^2$ spectrum and identify the primary product ion of interest, and then the third spectrum must be subtracted from the second spectrum in order to generate an $MS^3$ spectrum (in other words, an $MS^2$ spectrum of the primary product ion).

The first technique taught above is complex, and requires a number of separate quadrupoles or the like, and the ability to move the ions sequentially through the different quadrupole sections. The technique taught in the Finnigan patent is complex and requires a number of steps. Also, it is concerned with ion traps and not a flow quadrupole. While all of the above methods can be used to obtain $MS^3$ spectra (or higher order), they all suffer from some limitations or drawbacks. The ion trapping methods require isolation of the first parent ions before fragmentation, and then sequential steps of fragmentation, isolation and fragmentation in order to reach $MS^3$. The initial ion mass which is fragmented is not mass selected.

The method described in Whitehouse et al to achieve $MS^3$ is complex, and reduces the duty cycle for the overall process (as described by the inventors of the '259 patent) to 33% for $MS^3$. Also, the mass-selective specificity of the first fragmentation step, obtained by exciting the ion radially to collide and fragment is much less than that achievable by using a mass spectrometer (a quadrupole mass filter for example). Therefore, the method taught is both less sensitive and less mass-selective than that described in the present application. Finally, these inventors fail to recognize that simple subtraction alone will not always give an accurate representation of the true fragment spectra; the present inventors have realized further statistical analysis is required to eliminate uncertainties due to poorly subtracted spectra.

Accordingly, it is desirable to provide one technique which, in one device, readily enables ions of a selected mass-to-charge ratio to be subject to collision-induced-dissociation (CID) or fragmentation, so that the fragments can be transported further for subsequent analysis. It is desirable to provide this in a single device, since movement of ions from one device to another inevitably leads to some losses. Similarly, the techniques of the Finnigan patent works effectively with pulse ion sources, but inefficiently with continuous ion flow, for instance from an electrospray ion source. In this field, spectrometers are frequently used to analyze small samples, and often, high efficiency is required, if any reliable reading or measurement is to be obtained.

SUMMARY OF THE INVENTION

In accordance with a first aspect of the present invention, there is provided a method of analyzing a substance, the method consisting of:

(1) creating a stream of ions in said substance;

(2) supplying the stream of ions and a collision gas to a multipole and providing an RF signal to the multipole, whereby the multipole functions as a collision cell;

(3) fragmenting said ions in the RF multipole by collisions with the gas molecules, in order to form primary fragment ions;

(4) supplying additional alternating current to the multipole at a frequency selected to cause resonance excitation of a desired primary fragment ion mass-to-charge ratio, whereby ions with said desired primary fragment ion mass to charge ratio are excited and undergo collisions with the gas molecules causing production of secondary fragment ions;

(5) modulating the alternating current signal applied in step (4) whereby periods in which said alternating current signal is applied alternate with periods in which the alternating signal is not applied;

(6) detecting the ion signal after fragmentation with a mass spectrometer and collecting one set of data for one spectrum, representative of the ion spectrum when the alternating current signal is applied and another set of data for another spectrum, representative of the ion spectrum when the alternating current signal is not applied;

whereby said other spectrum can be subtracted from said one spectrum, to generate a subtracted spectrum showing the secondary fragment ions without the presence of the primary fragment ions except for any said primary fragment ions which are generated by step (4), whereby to obtain $MS^3$ information.

In one embodiment, the method further includes the step of processing the data sets by applying statistical analysis to reject spectra having statistically insignificant variations in the ion signal.

Preferably, the statistical analysis is implemented in a software program and performed automatically.

More preferably, the statistical analysis is performed in real time so that spectra having statistically insignificant variations in the ion signal are not displayed.

In one embodiment, the alternating current signal is at a frequency that excites the desired primary fragment ion.

Preferably, the method includes passing the stream of ions through a first mass analyzer to select a precursor ion of interest, and passing the precursor ion into the collision cell.

More preferably, the method includes providing a potential difference between the first mass analyzer and the collision cell, to accelerate the precursor ion into the collision cell, whereby the precursor ions gain sufficient velocity to collide with the buffer gas to cause fragmentation, and wherein step (4) comprises applying an alternating current signal to excite a fragment of the precursor ion, said fragment comprising the desired ion.

The method can include applying a second alternating current signal to the quadrupole rod set, to excite a fragment ion resulting from resonance excitation of said desired ion, thereby to generate secondary fragment ions and wherein step (5) comprises modulating the second alternating current signal. It will be appreciated that it may be possible to apply a number of different excitation signals to cause fragmentation of fragments from the previous step.

Another aspect of the present invention provides an apparatus, for analyzing a substance by resonance excitation of selected ions and selective collision-induced dissociation, the apparatus comprising:

an ion source for generating a stream of ions;

a collision cell, including a quadrupole ion guide, for receiving a stream of precursor ions and provided with a collision gas, for collision-induced dissociation between the parent ions and the buffer gas;

a power supply connected to the quadrupole rod set for generating an RF field in the quadrupole rod set for guiding ions and for applying an additional alternating current field at a frequency selected to excite a desired ion;

a modulation means connected to the power supply, for modulating the alternating current signal, whereby periods in which said alternating current signal are applied alternate with periods in which the alternating current signal is not applied.

Preferably, the apparatus additionally includes a detector for detecting fragment ions exiting the collision cell, a switch connected to the detector, two data storage devices connected to the switch, and a connection between the modulation control unit and the switch, whereby the switch switches detected data for periods when the alternating current signal is applied to one data storage device and collected data for periods when the alternating current signal is not applied to the other storage device.

To enable a second excitation step to be effected, the apparatus can include a second power supply connected to the quadrupole rod set, a second modulation unit connected to the second power supply and also to the switch, before applying a second alternating current signal, for excitation of a second ion.

Preferably the apparatus includes a first mass analysis section for selecting a parent ion and a final mass analysis section, including the detector, for analyzing fragment ions from the collision cell.

BRIEF DESCRIPTION OF THE DRAWING FIGURES

For a better understanding of the present invention and to show more clearly how it may be carried into effect, reference will now be made, by way of example, to the accompanying drawings in which.

Figure 4A:
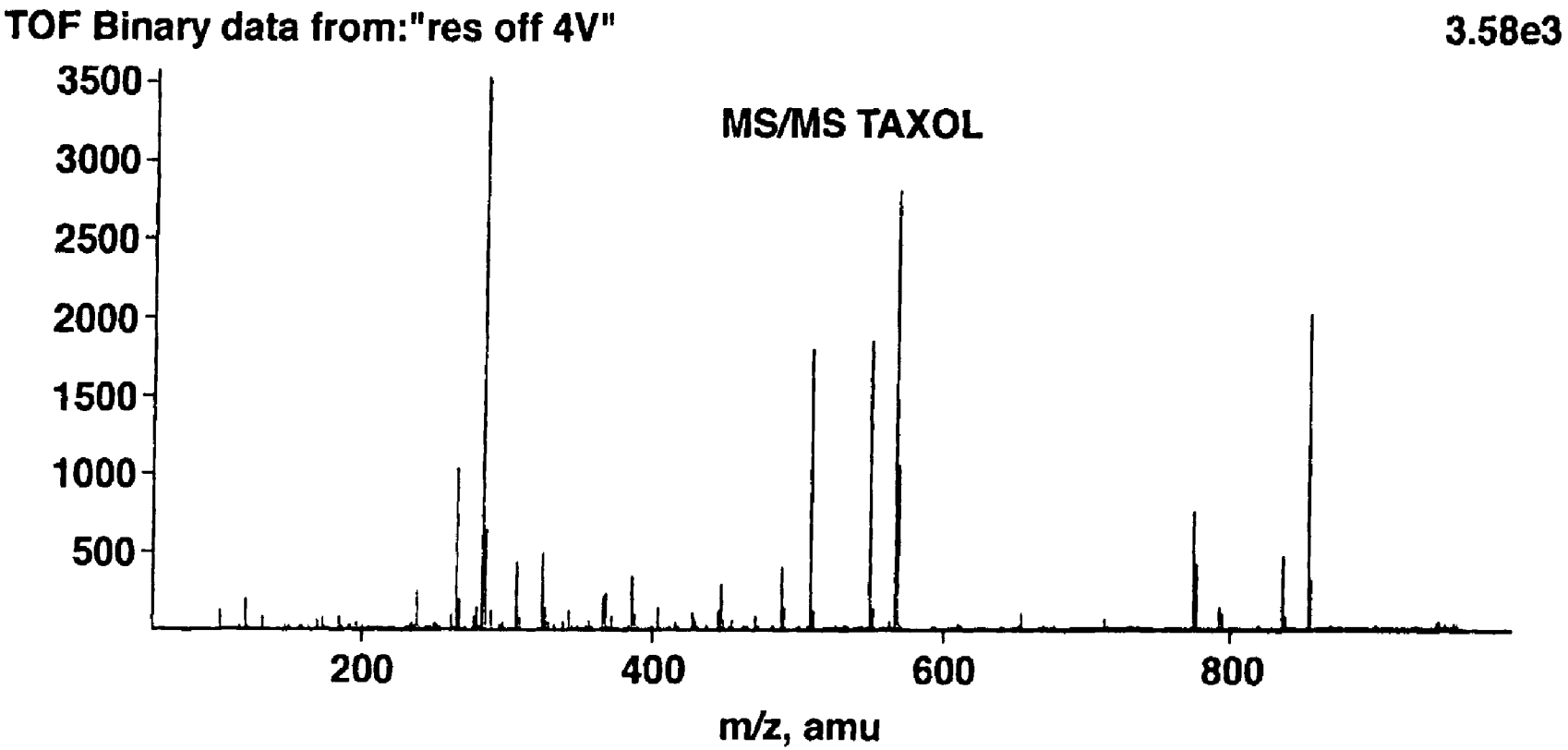
Figure 5A:
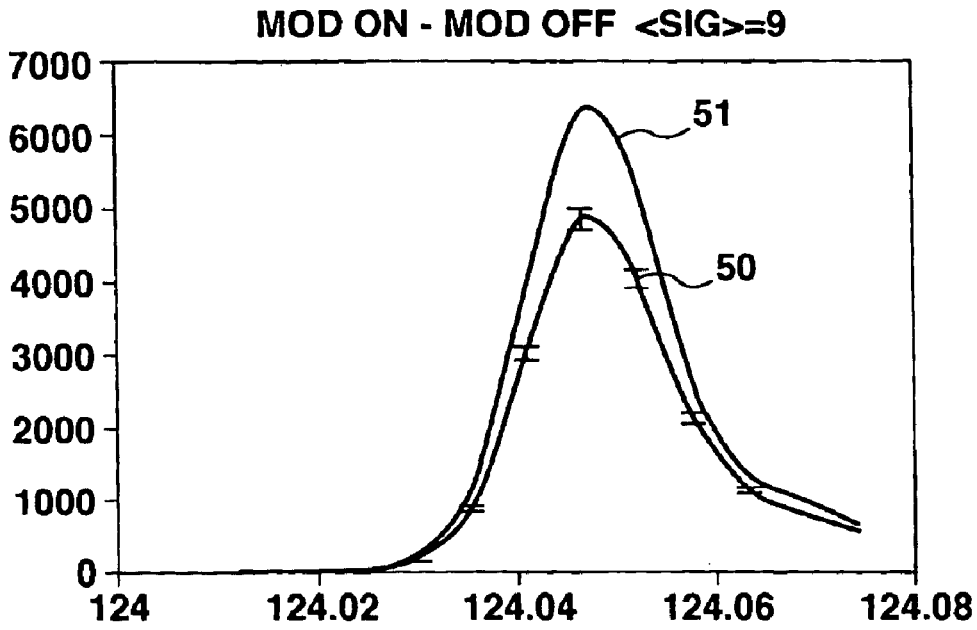
Figure 5B:
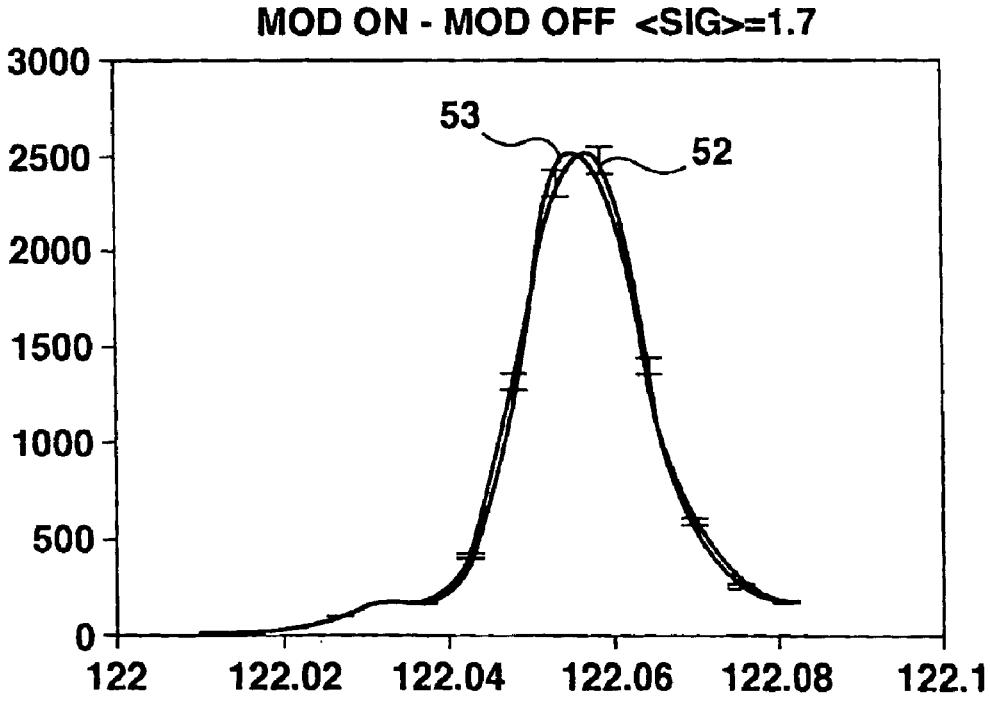

FIGS. 3*a*–3*e* are mass spectra showing analysis of bosentan and fragments thereof;

FIGS. 4*a,* 4*b* and 4*c* are spectra showing fragmentation of taxol;

FIGS. 5*a* and 5*b* are detailed graphical spectra of fragments obtained from fragmentation of a fragment of mass 202 of bosentan;

FIGS. 6*a*–6*c* and 7*a*–7*c* are mass spectra showing $MS^3$ and $MS^4$ fragmentation schemes for reserpine; and FIGS. 8*a*–8*d* are subtracted $MS^3$ mass spectra of Reserpine at various excitation amplitudes.

DETAILED DESCRIPTION OF THE PREFERRED EMBODIMENTS

Figure 1:
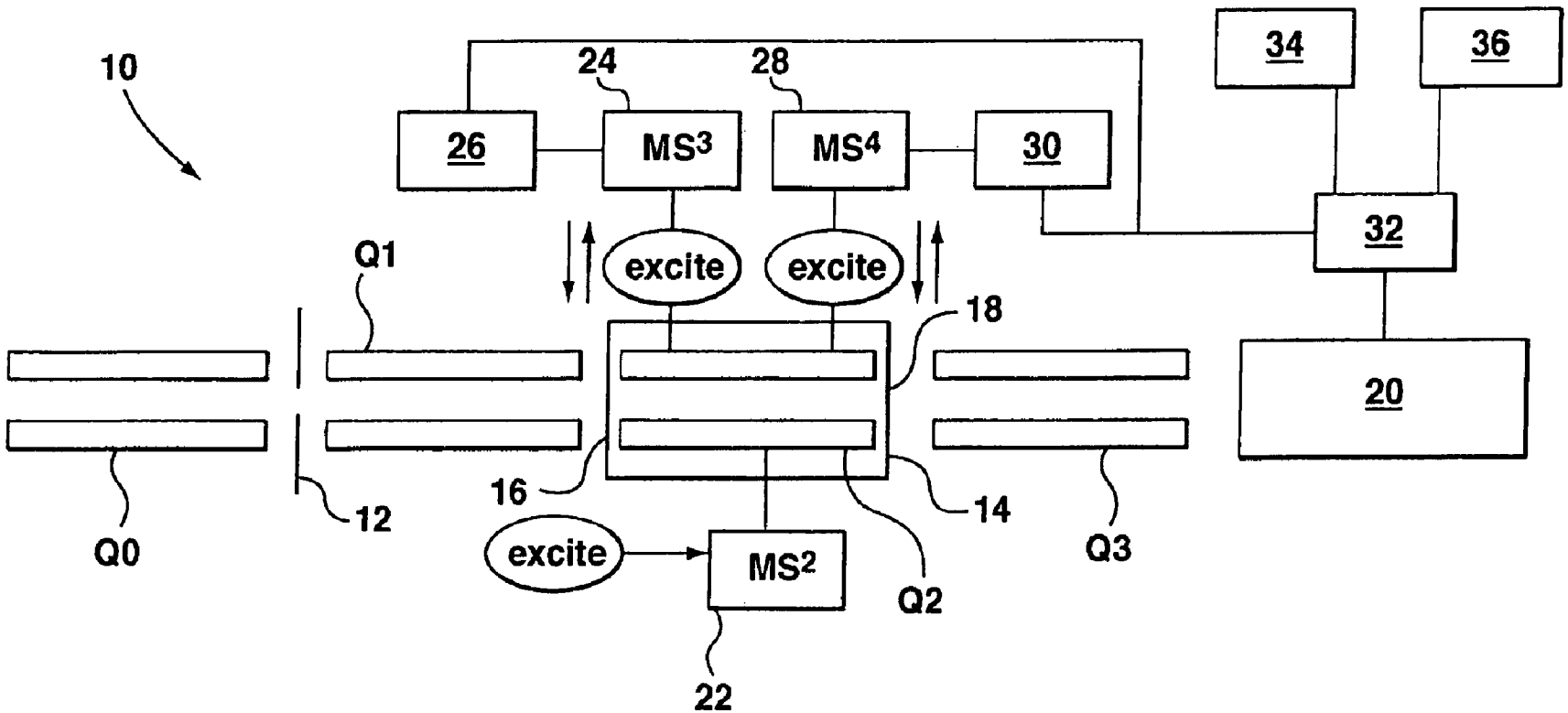
FIG. 1 is a schematic of a first embodiment of an apparatus in accordance with the present invention.
Figure 2:
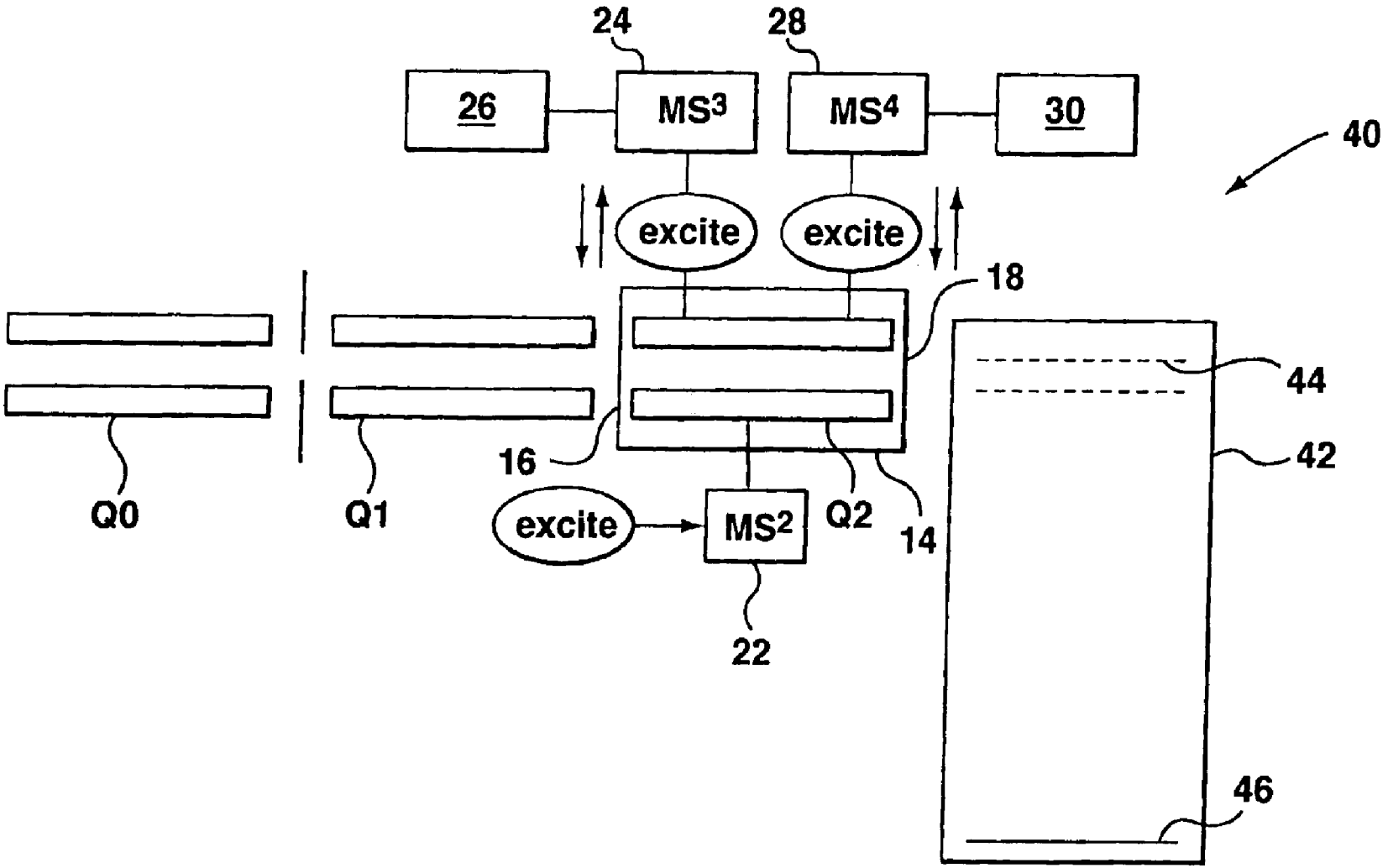
FIG. 2 is a schematic of an apparatus in accordance with a second embodiment of the present invention.

A description is first given of the apparatus in FIGS. 1 and 2. The two apparatus are largely similar, except for the final mass analysis stage. FIG. 1 shows a variant with a quadrupole rod set and detector as the final mass analysis stage, while this is effected by a time-of-flight section in FIG. 2.

Referring first to FIG. 1, the first variant of the apparatus is indicated at 10. In known manner, the apparatus 10 includes a first quadrupole rod set generally indicated as Q0. Q0 is intended to collimate and reduce the energy of ions received from an electrospray source or the like. In known manner, upstream of Q0, there would be an ion inlet, skimmers, intermediate pressure stages and the like, all intended to remove gas and reduce pressure down to that required for mass analysis (these elements and associated pumps are not shown). Q0 collimates the ion beam and further serves to reduce gas pressure.

Ions from Q0 pass through an interquad aperture 12 into a quadrupole rod set Q1, which functions as a first mass analysis section. In known manner, Q1 is supplied with resolving RF and DC voltages. These can be conventional and the power supplies are not shown.

From Q1, the ions pass through into a collision cell housed in a chamber generally indicated 14. The collision cell includes a quadrupole rod set Q2. The chamber 14 includes, at either end, an inlet interquad aperture 16 and an exit interquad aperture 18.

The ions then pass into a final quadrupole Q3. Q3 again would be provided with resolving RF and DC voltages, and the power supply for these is not shown. Finally, the ions pass through to a detector 20.

In known manner, appropriate DC potentials would be provided between the different quadrupole sections Q0, Q1, Q2 and Q3 and also appropriate potentials on the interquad apertures 12, 16, 18, together with an appropriate potential drop to the detector 20. These various potentials ensure movement of ions axially, from left to right in FIG. 1, in known manner.

Quadrupoles Q1, Q3 would be maintained at a low pressure of $10^{-5}$ torr, as is known for mass resolving quadrupoles. Chamber 14 is operated as a collision cell and would be provided with a suitable collision gas (source not shown). Typically, it is operated at a pressure in the range 0.5–20 mTorr. A suitable collision gas is nitrogen.

In accordance with the present invention, a first MS step is effected in Q1. This selects a parent or precursor ion, which then passes into the rod set Q2 of the collision cell. To effect a second MS step, $MS^2$, ions are accelerated into a quadrupole collision cell (Q2), effecting fragmentation through collision with a low pressure gas in Q2 to generate primary fragment ions. A radio frequency (RF) source 22 for rod set Q2 is indicated, for example, 1,000 volts at 2 MHz. An auxiliary RF voltage would be provided in a quadrupolar, dipolar or any other suitable manner, i.e. with the cos ωt provided to one opposite pair of rods in the quadrupole rod set Q2, and −cos ωt provided to the other, diagonally opposite pair of rods of the rod set Q2.

It will be appreciated that while each fragmentation step is designated $MS^2$, $MS^3$, etc., the final MS step is effected in Q2 (or other downstream mass analyzer). Also, the number of fragmented ion steps is 1 less than the total number of MS steps, i.e. $MS^2$ has one fragmentation step, $MS^3$ has two fragmentation steps, and $MS^n$ has n−1 fragmentation steps.

Another way of expressing this is to note that a mass analysis step as such is not effected in the collision cell or quadrupole Q2. Rather fragment ions are generated in Q2 for mass-analysis in a downstream mass analyzer. Thus a reference, for example, to $MS^2$ occurring in Q2 means that fragment ions are generated in Q2, and that these are then mass analyzed downstream in Q3, to provide the second mass analysis step.

Note also, while this description of the preferred embodiment assumes in all cases a first mass analysis step in Q1, this may not be essential. Thus, it may be desirable to analyze ions from a pure, single component sample, if only to record the characteristic fragmentation characteristics of the chosen component. In such a case, it may be possible to omit the first mass selection step in Q1. In this case, the total number of fragmentation steps will equal the number of mass-analysis steps.

Now, in accordance with the present invention, the rod set Q2 is further excited to effect either one or a multiple steps of excitation.

Firstly, a further excitation step $MS^3$ is effected by an excitation source 24 provided with a modulation control unit 26, whose function is explained below which causes secondary fragment ions to be generated from the primary fragment ions. To effect a third or tertiary fragmentation step, a second power supply 28 is provided, connected to a second modulation control unit 30. Each of the power supplies 24, 28 can provide a similar signal to the rod set Q2, the signal as being selected to excite different fragments, as detailed below, and the basic scheme is described in relation to the third mass selection step $MS^3$, involving two fragmentation steps, with the control unit 24.

Each ion has a secular frequency v. which is related to the drive frequency $\Omega/2\pi$, and the following Mathieu parameter $\beta$, as follows:

$$v = \frac{\beta\Omega}{2} \text{ for } n = 0 \tag{1}$$

for n=0

For q<0.6, this reduces to $$\text{For } q < 0.6, \text{ this reduces to } v = \left(a + \frac{q^2}{2}\right)^{\frac{1}{2}} \frac{\Omega}{2} \tag{2}$$

where a and q are standard Mathieu parameters given by:

$$a = \frac{8cU}{mr^2\Omega} \tag{3}$$

$$q = \frac{4eV}{mr^2\Omega^2} \tag{4}$$

Thus, for a=0, the relationship reduces to:

$$v = \frac{q\Omega}{2\sqrt{2}} \tag{5}$$

In accordance with the present invention, an excitation voltage is applied to the rod set Q2 at a frequency which is twice the secular frequency, i.e. with a frequency of $\omega$=2v ion. This would be at a potential v, in the range of 0.5 to 20 volts. This potential will be added to each of the potentials supplied to each pair of rods of the rod set Q2. Thus, the potential supplied to the pairs of rods would be as follows:

$$V \cos \Omega t + v \cos (\omega t + \phi) \tag{6}$$

$$-V \cos \Omega t - v \cos (\omega t + \phi)$$

where $\phi$ is simply a factor to allow for the fact that the two signals need not necessarily be in phase.

Thus, to effect the different steps of $MS^3$ and $MS^4$, it is a matter of selecting different frequencies of $\omega$, corresponding to ions of interest, as explained in greater detail in relation to the examples below. Alternatively, however, from equation (5) it is evident that one could select a different RF voltage, or select a different q for a constant excitation frequency.

Additionally, an important aspect of the invention is to modulate the additional excitation provided by the power supplies 24, 28. For this purpose, each power supply 24, 28 is shown with a respective modulation control unit 26, 30. For some purposes, it may be suitable or possible to provide a single modulation control unit and a single power supply, which together are switchable between the different characteristics required for each fragmentation step.

Modulation control units 26, 30 effectively turn on and off the power supplies 24, 28, with a square wave signal at a frequency of, for example 2 Hz. In other words, the power supply 24, 28 as the case may be, would be turned on for 0.25 seconds, turned off for 0.25 seconds, etc. The reason for this is to provide data with and without excitation, to enable subtraction of the different signals obtained. Comparing results with excitation on and excitation off for any lengthy time period is impractical, since any analyzer or detector tends to show drift for a variety of reasons. That is, a signal measured will drift by the order of a few percent over time. In many cases, as detailed below, comparison of two signals, with excitation on and excitation off, amounts to obtaining a small difference between two relatively large signals. If either one of these has drifted significantly, then this can lead to a major error in the small, calculated difference.

FIG. 1 also shows a modification to a conventional mass spectrometer apparatus, required by the present invention. Thus, the detector 20 is connected to a switch 32. The switch 32 is connected to and controlled by either one of the modulation control units 26, 30. The switch 32 has two outputs connected to separate data storage devices 34, 36. Thus, the data storage device 34 is for when there is no excitation and the data storage device 36 is for when excitation is provided.

Then, in use, when modulation is effected by either of the units 26, 30, and note that this is irrespective of any voltage set by the power supply 24, 28, the output from the detector 20 is switched by the unit 32 alternately between the two data storage devices 34, 36, in synchronism with the modulation. This enables collection of two sets of data, one when excitation is effected and one when excitation is not effected. As detailed below, this gives different spectra, which can be subtracted from one another.

Still referring to FIG. 1, significantly, the use of a preselecting mass filter in the present application allows the first fragmentation to be non-selective, via a potential gradient. This is preferable because typically much more energy can be deposited into the initial ions, which may include hard to break bonds and massive molecules. The present inventors have appreciated that there would be sufficient cooling of the primary fragment ions and any residual precursor ions in the second multipole to permit efficient radial excitation for subsequent MS steps.

Reference will now be made to FIG. 2. This shows an apparatus indicated generally by the reference 40. The apparatus 40 is similar to the apparatus 10, and for simplicity and brevity, like components are given the same reference numeral and the description of these components is not repeated. In brief, the apparatus 40 includes the first three quadrupole rod sets Q0, Q1 and Q2, and associated control and power supply elements.

However, here, to replace the final quadrupole Q3 and detector 20, there is provided a time-of-flight (TOF) mass analyzer 42. In known manner, the TOF analyzer of section 42 includes a gating region 44 and a detector 46. Thus, in use, ions pass into the gating region 44 and are gated or pulsed out to travel down the main body of the TOF 42, following a drift tube, until detected at a detector 46.

It will be appreciated that any suitable form of TOF could be provided. Thus, the TOF could comprise a reflectron or the like.

Reference will now be made to FIGS. 3–6 and also to Tables 1 and 2, which show mass spectra data collected in accordance with the present invention. All this data was collected on an apparatus using a TOF section, as in FIG. 2.

Figure 3A:
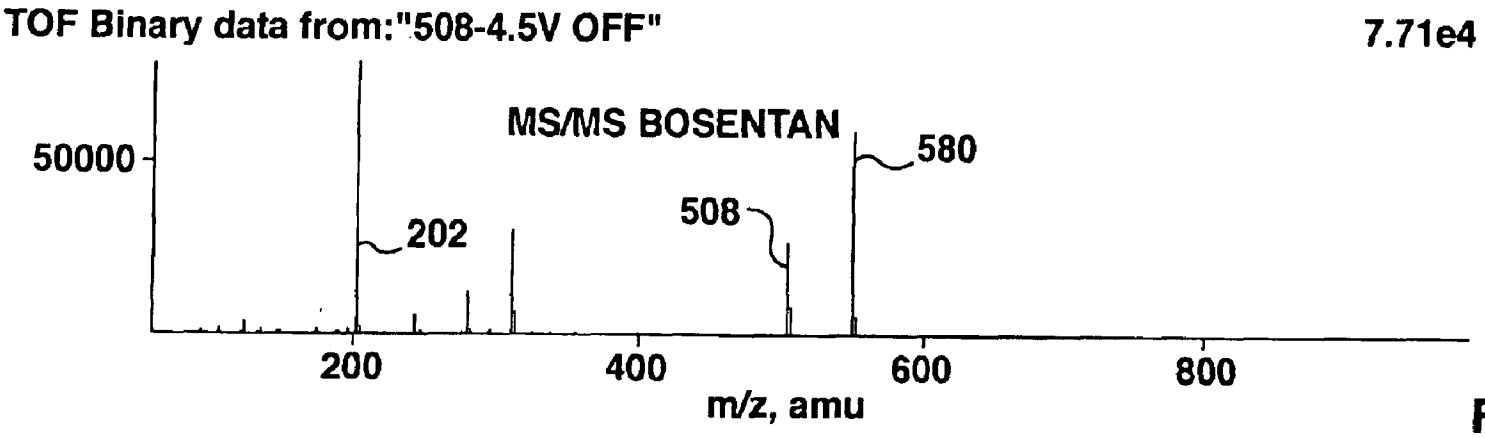

Referring first to FIG. 3*a,* there is shown a mass spectrum resulting from carrying out the first two MS steps, $MS^1$ and $MS^2$, on bosentan, a low mass chemical or drug, with a mass of 580. Thus, in Q1, the voltages are set to select m/z 580 from bosentan, which is then accelerated into Q2 to fragment it, to generate the spectrum shown in FIG. 3*a;* it will again be appreciated that the second mass analyzing step is in fact effected in TOF mass analyzer 42. As shown, this includes some residual amount of the original bosentan at mass 580 and other significant peaks of fragments at 508 fragments close to mass 200 and others.

Figure 3B:
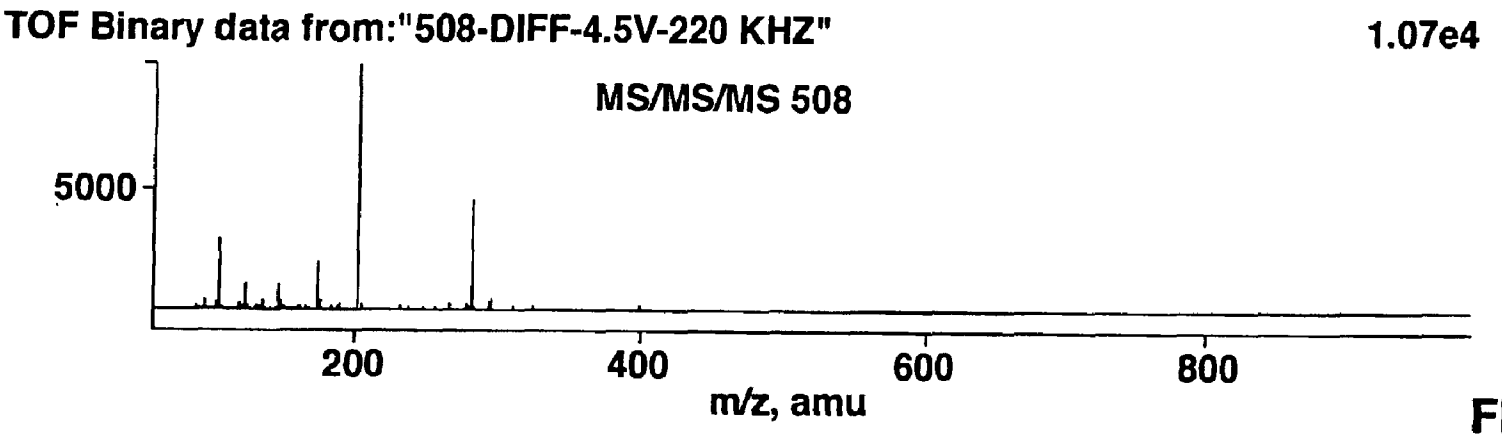
Figure 3C:
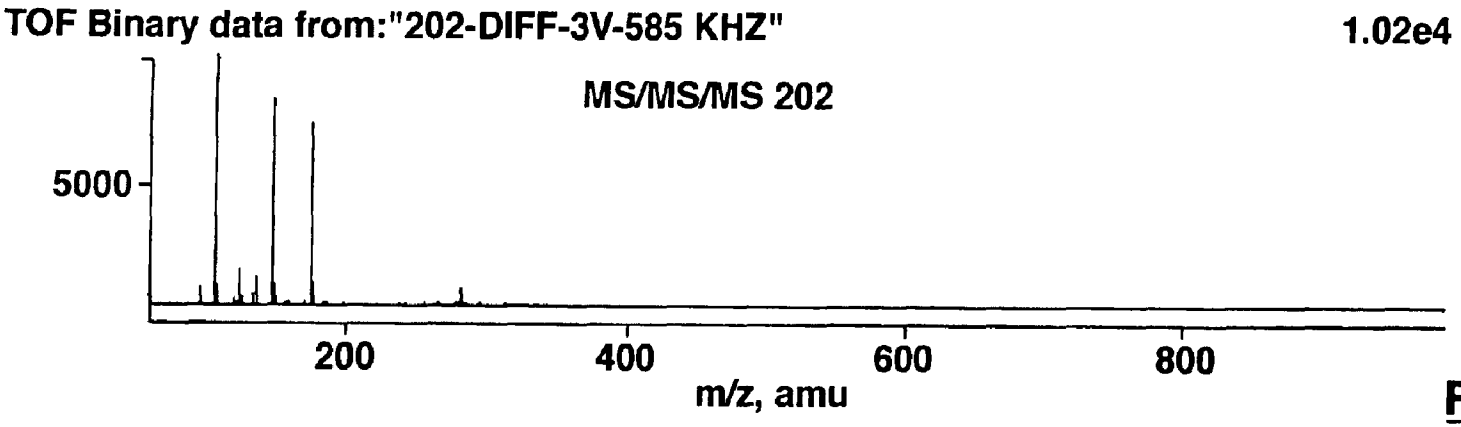
Figure 3D:
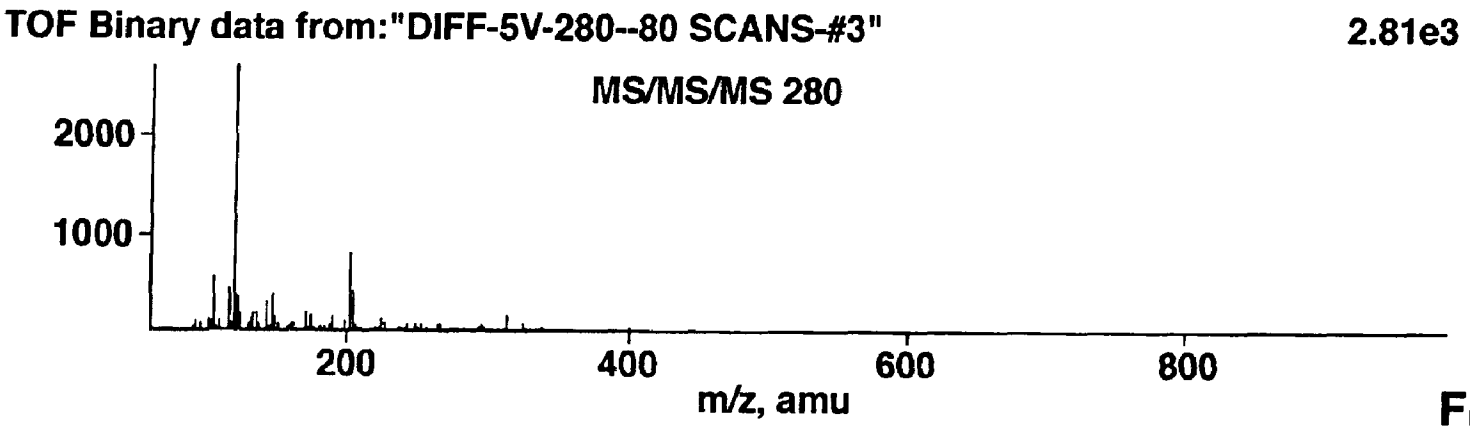

FIGS. 3*b*–3*d* then show subtracted spectra obtained by applying the third MS step, $MS^3$, with a frequency set to excite an ion with an m/z 508, 202 and 280, respectively. For example, fragmentation of m/z 508 is achieved by applying a 4.5 volt excitation signal at a frequency of 220 kHz. As indicated on FIG. 3*b,* this effects MS/MS/MS (or $MS^3$).

FIG. 3*b* shows a subtracted spectrum. Thus, FIG. 3*b* shows the spectrum obtained by effecting the triple MS technique, with the spectrum of FIG. 3*a* subtracted. Here, any negative quantities are shown as zero. For example, the peak for mass 508 will, clearly, be much less in FIG. 3*b,* so the subtraction of the spectrum of FIG. 3*a* would give a negative value; in FIG. 3*b,* this is graphed. This technique has the effect of subtracting any fragments that were present as a result of the $MS^2$ ion fragmentation. However, as explained below, further analysis of FIGS. 3*b*–3*d* is required to determine which peaks are true $MS^3$ and which peaks result from incompletely subtracted spectra, due to signal fluctuations alone.

Figure 3E:
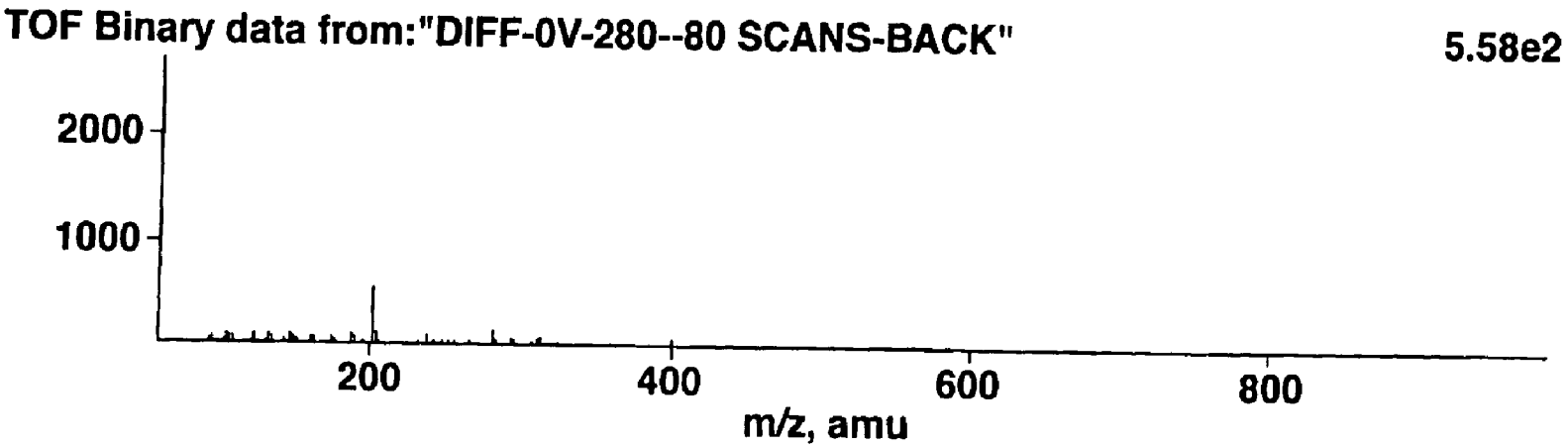

FIG. 3*e* shows a scan obtained by effecting modulation with modulation control unit 26, to provide the received signal into the two separate data streams, to collect two sets of data. However, the voltage supplied by the unit 24 is set to zero. In effect, FIG. 3*e* shows the subtraction of what in theory should be two identical outputs. As can be seen, the spectra does show some measurable peaks. Note that these peaks result from, in effect, the subtraction of two relatively large quantities, to give a small difference. The vertical scale in FIG. 3*e* is different from that in the other figures. What this shows is that there will, in practice, be some fluctuation of the signal, and this can be some measure of the fluctuation for individual fragments, and it can be noted that the fragment 202 shows a significant fluctuation. Thus, a statistical analysis of the significance level of the subtracted ion signal is used, as explained below. Processing of data sets collected for the statistical analysis allows identification and possible elimination of the non-coherent variations in the ion signal.

While the statistical analysis is presented here by way of equations and tables, it will be appreciated that the analysis may be automated by implementing it in a software program running on a data processor, so as to process the data as it is recorded. This will permit rapid "real time" determination of whether the value of the subtracted data is significant. Optionally, only data which is determined to be significant after such statistical analysis can be selected for presentation.

Figure 4B:
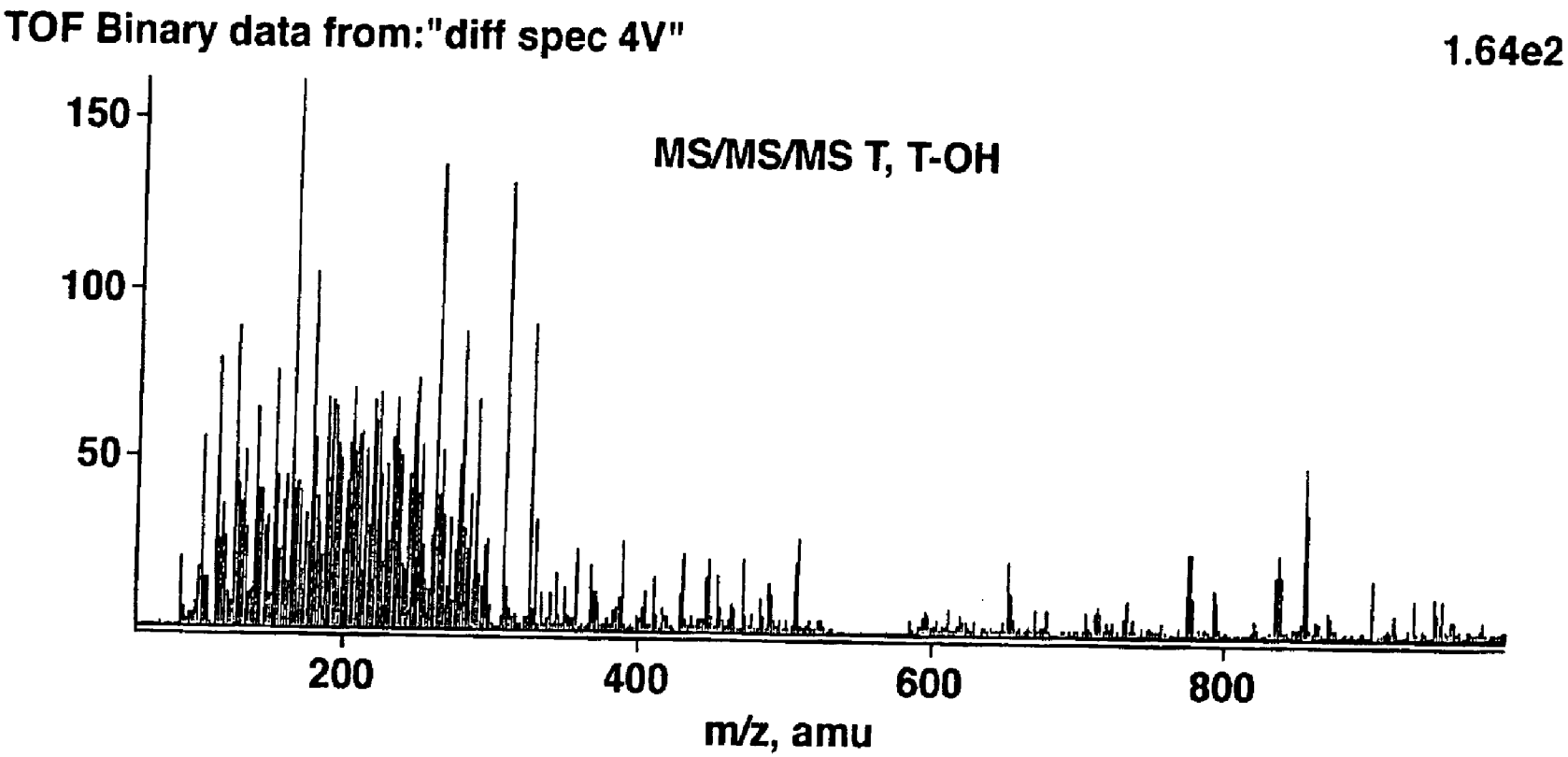

Turning to FIGS. 4*a* and 4*b,* these show test results and spectra obtained for the drug taxol. FIG. 4*a* shows a basic two-step $MS^2$ process. That is, taxol was selected in Q1, for transmission into Q2; the taxol is then accelerated into Q2 with a suitable potential difference, to cause CID or fragmentation of the taxol in Q2. The spectra in FIG. 4*a* was then obtained.

FIG. 4*b* then shows the spectrum obtained by further excitation, i.e. $MS^3$. FIG. 4*b* is a subtracted spectrum. This shows a significant range of fragments for approximately 100 m/z to 400 m/z. Notably, even though there are significant peaks in this range in FIG. 4*a,* the same ions are also generated by the subsequent fragmentation.

Figure 4C:
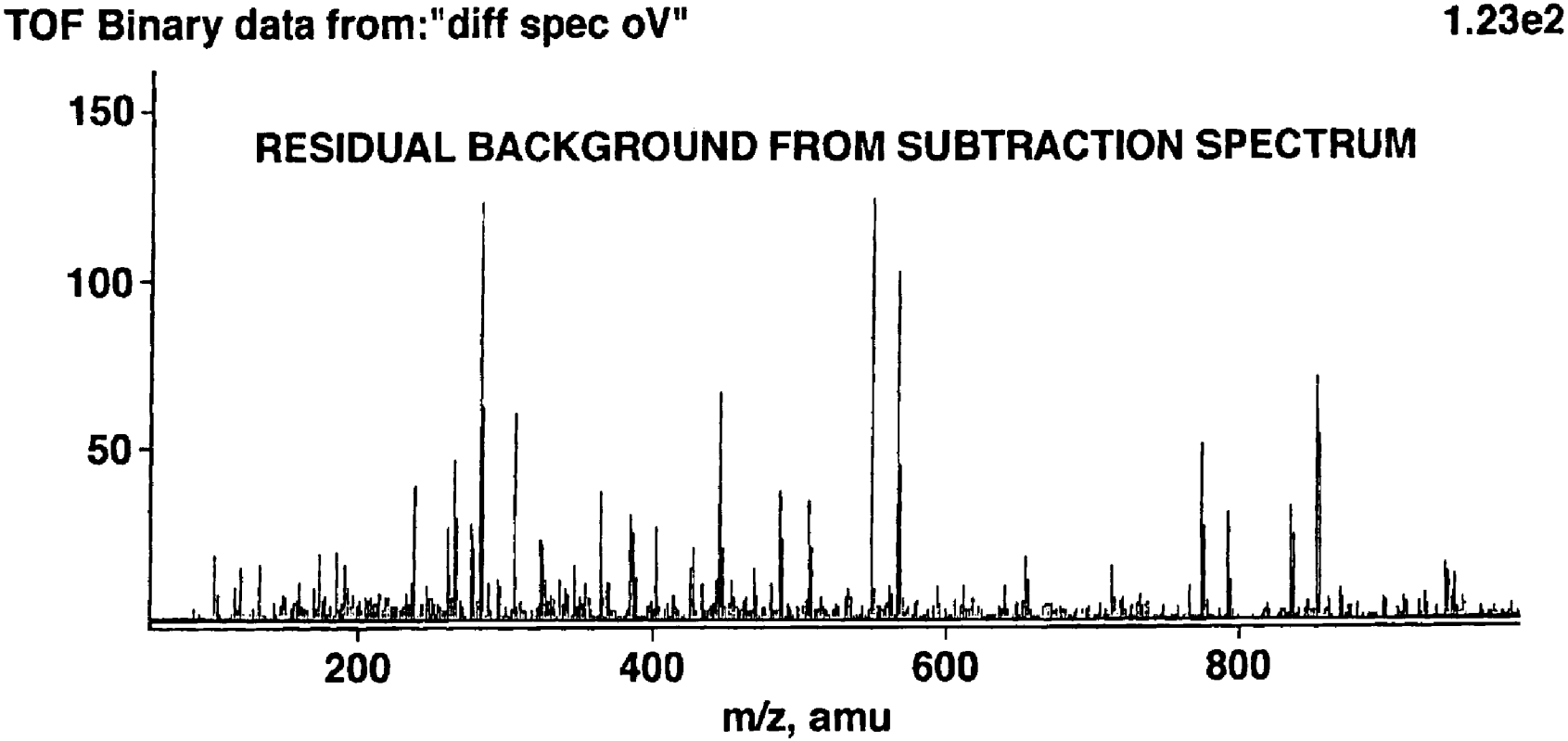

FIG. 4*c* again shows a subtraction spectrum obtained without any excitation. In other words, with modulation unit 26 actuated, to cause the data to be divided into two sets of data, but with the power supply 24, set to give zero excitation. Surprisingly, for taxol, this shows a significant residual background.

Referring now to FIGS. 5*a* and 5*b* these show, in greater detail, a graphical representation of the signal obtained around the peak 124 and 122, as a result of exciting the fragment 202; thus these figures show details of the scan of FIG. 3*c*.

FIG. 5*a* shows two peaks 50 and 51. Peak 50 is the signal obtained with the additional excitation provided by the unit 24 turned off, and this also shows error bars indicating the variance in the signal obtained. Peak 51 shows the signal obtained with power supply 24 actuated, to provide excitation of fragment 202, generating an additional quantity of the ion around mass 124. A subtracted spectrum would effectively show peak 51 minus peak 50. This demonstrates that a fragmentation of ion 202 does add significantly to a fragment at mass 124.

FIG. 5*b* shows similar peaks 52 and 53 at mass 122. Again, error bars for the peak 52 are shown. Peak 52 shows the spectra with no excitation of ion 202, while peak 53 shows the spectra with 202 excited. This shows where the two peaks are effectively identical, allowing for a margin of error. In other words, fragmentation of ion 202 does not add significantly to the signal at mass 122.

Thus, in order to ascertain which fragment signals are significant, the present invention incorporates statistical analysis for determining when fragmentation of a particular ion has added to the signal for a smaller fragment, and when no such effect is present. This is based on two basic principles, namely: firstly, simply subtracting the two peaks, as indicated for the peaks in FIGS. 5*a,* 5*b* and determining that there is a significant additional added signal, when there is a significant and measurable difference between the two peaks; and comparing two peaks to determine if there is significant fluctuation in values. This latter feature is explained in greater detail in relation to Tables 1 and 2.

Referring first to Table 1, this shows four sets of data, for different peaks at, approximately 124, 98, 106 and 79, where it is determined that fragmentation of the 202 ion did add significantly to a peak. These peaks were chosen, representative of, respectively, "medium", "little", "big" and very little peaks, the adjectives indicating relative peak size. For each ion, there are two columns, indicating the count made, with excitation on and excitation off respectively.

Thus, for ion 124, counts are obtained at masses ranging from 124.0131 to 124.0735. The final column calculates a significance factor |T| or "Sig" using a statistical method called the "T" test. This test permits comparison of two parent populations to determine the degree to which they are different. This method is derived from probability statistics assuming a Gaussian distribution of ions in time; other probability functions may be used. While this statistical method considers the magnitude of the significance factor, other methods may take polarity information into consideration. The value of |T| is calculated by the following equation:

$$|T| = Sig = \left| \frac{\text{detected ion signal, alternating current on} - \text{detected ion signal, alternating current off}}{\sqrt{\sigma^2 \text{ alternating current on} + \sigma^2 \text{ alternating current off}}} \right| \quad (7)$$

where σ is the standard deviation. Here, a value of |T| of ~two or less, indicates that there is a greater than ~95% probability that the excitation on and off signals are the same. On the other hand, for this mass 124, one can see that the values of |T|, at the peak, are in excess of 10, clearly indicative of a substantial difference, and this is borne out by the visual representation in FIG. 4*a*.

Similar results, although not quite so strong, were obtained for the peak and mass 98. This again shows that, for nearly all values around the peak 98, the on signal gave a higher signal than the off signal. Again, value of |T| was quite high around the peak.

In general, it would be noted that it is more difficult to make a clear determination for smaller peaks.

For a large or big peak, as shown for the mass 106, the difference between the on and off signals was significant, and it is noted that the value of |T| reached a value of in excess of 57 close to the peak. This is clearly indicative of a substantial difference between the on and off signals, thereby indicating that the fragmentation of ion 202 did contribute significantly to the fragment and mass 106.

Finally, for the ion at mass 79, this represents another, smaller peak. This again gives a clear indication that there was a difference between the two signals.

TABLE 1

| M/Z | ON | OFF | [T] |
|---|---|---|---|
| | | MED#, YES | |
| 124.0131 | 7 | 11 | 0.943 |
| 124.0186 | 20 | 11 | 1.62 |
| 124.0241 | 40 | 36 | 0.459 |
| 124.0296 | 162 | 149 | 0.737 |
| 124.0351 | 1117 | 874 | 5.44 |
| 124.0406 | 3854 | 3036 | 9.85 |
| 124.0461 | 6377 | 4865 | 14.3 |
| 124.0516 | 5321 | 4073 | 12.9 |
| 124.0571 | 2596 | 2164 | 6.26 |
| 124.0626 | 1420 | 1163 | 5.06 |
| 124.0681 | 1016 | 829 | 4.35 |
| 124.0735 | 663 | 566 | 2.77 |
| | | LITTLE, YES | |
| 98.0192 | 1 | 1 | 0 |
| 98.0241 | 4 | 2 | 0.816 |
| 98.0289 | 13 | 13 | 0 |
| 98.0338 | 61 | 28 | 3.50 |
| 98.0387 | 91 | 66 | 1.99 |
| 98.0436 | 103 | 51 | 4.19 |
| 98.0485 | 43 | 33 | 1.15 |

TABLE 1-continued

| M/Z | ON | OFF | [T] |
|---|---|---|---|
| 98.0534 | 26 | 15 | 1.72 |
| 98.0583 | 6 | 13 | 1.61 |
| 98.0632 | 7 | 5 | 0.577 |
| 98.068 | 1 | 6 | 1.89 |
| 98.0729 | 3 | 2 | 0.447 |
| 98.0778 | 3 | 5 | 0.707 |
| 98.0827 | 3 | 6 | 1.00 |
| | | BIG, YES | |
| 105.9971 | 18 | 11 | 1.30 |
| 106.0021 | 10 | 7 | 0.728 |
| 106.0072 | 29 | 11 | 2.85 |
| 106.0123 | 46 | 19 | 3.35 |
| 106.0174 | 120 | 58 | 4.65 |
| 106.0225 | 803 | 437 | 10.4 |
| 106.0275 | 5560 | 2858 | 29.5 |
| 106.0326 | 16232 | 8273 | 50.8 |
| 106.0377 | 20957 | 10723 | 57.5 |
| 106.0428 | 13267 | 6652 | 46.9 |
| 106.0479 | 5185 | 2784 | 26.9 |
| 106.053 | 2119 | 1174 | 16.5 |
| 106.058 | 1362 | 766 | 12.9 |
| | | V. LITTLE, YES | |
| 79.0072 | 0 | 0 | 0 |
| 79.0116 | 1 | 1 | 0 |
| 79.016 | 8 | 2 | 1.90 |
| 79.0204 | 27 | 9 | 3.00 |
| 79.0248 | 38 | 12 | 3.68 |
| 79.0291 | 58 | 9 | 5.99 |
| 79.0335 | 36 | 5 | 4.84 |
| 79.0379 | 15 | 5 | 2.24 |
| 79.0423 | 7 | 4 | 0.905 |
| 79.0467 | 6 | 5 | 0.302 |
| 79.0511 | 11 | 5 | 1.50 |
| 79.0555 | 11 | 2 | 2.50 |
| 79.0598 | 0 | 3 | 1.73 |
| 79.0642 | 2 | 1 | 0.577 |
| 79.0686 | 4 | 0 | 2.00 |
| 79.073 | 3 | 0 | 1.73 |

Turning to Table 2, this shows sets of data indicating a situation where fragmentation of ion 202 showed little variation in the on and off signals, indicating that the peaks were essentially the same, and for which the additional third MS step added nothing to the peak. Table 2 again shows, in the same order, data for a medium, little, big and very little peaks, at masses 122, 131, 123 and 103 respectively.

The column for the factor |T| shows that for the mass 122, |T| often has a value of much less than 1, and only exceeds 1 for a couple of the data points. This is clearly indicative of two peaks that are the same and have no statistically different magnitude. This data corresponds to FIG. 4*b*.

There is a similar effect for a small or little peak for the mass 131. Here, the values of |T| are even smaller, and it can be seen that many of the values for the difference figure are negative or very small.

For a big peak at mass 123, due to the larger size of the peaks, values for the difference and significance parameter |T| are larger Here, a review of the various values of the parameter |T| again clearly shows that these two peaks are substantially the same.

Finally, for mass 103, it can be noted that the values for the difference in |T| data are all extremely small. Again, a clear indication that there is no statistically significant difference between the two peaks.

TABLE 2

| M/Z | ON | OFF | [T] |
|---|---|---|---|
| | MED#, NO | | |
| 122.0154 | 12 | 9 | 0.655 |
| 122.0208 | 27 | 31 | 0.525 |
| 122.0263 | 76 | 92 | 1.23 |
| 122.0318 | 170 | 162 | 0.439 |
| 122.0372 | 153 | 159 | 0.340 |
| 122.0427 | 364 | 411 | 1.699 |
| 122.0481 | 1192 | 1289 | 1.95 |
| 122.0536 | 2480 | 2365 | 1.65 |
| 122.059 | 2381 | 2496 | 1.65 |
| 122.0645 | 1325 | 1401 | 1.46 |
| 122.0699 | 622 | 596 | 0.745 |
| 122.0754 | 285 | 257 | 1.20 |
| 122.0808 | 159 | 170 | 0.606 |
| | LITTLE, NO | | |
| 131.017 | 1 | 2 | 0.577 |
| 131.0226 | 12 | 12 | 0.000 |
| 131.0282 | 18 | 20 | 0.324 |
| 131.0339 | 26 | 22 | 0.577 |
| 131.0395 | 32 | 49 | 1.89 |
| 131.0452 | 132 | 133 | 0.061 |
| 131.0508 | 324 | 313 | 0.516 |
| 131.0565 | 463 | 507 | 1.41 |
| 131.0621 | 335 | 333 | 0.077 |
| 131.0678 | 172 | 186 | 0.740 |
| 131.0734 | 212 | 226 | 0.699 |
| 131.0791 | 385 | 386 | 0.036 |
| 131.0847 | 405 | 391 | 0.496 |
| 131.0904 | 204 | 203 | 0.050 |
| 131.096 | 81 | 86 | 0.387 |
| | | BIG, NO | |
| 123.0259 | 220 | 263 | 1.957 |
| 123.0314 | 1108 | 1098 | 0.213 |
| 123.0368 | 2737 | 2943 | 2.73 |
| 123.0423 | 3539 | 3554 | 0.178 |
| 123.0478 | 2622 | 2738 | 1.58 |
| 123.0533 | 3409 | 3343 | 0.803 |
| 123.0587 | 7021 | 7081 | 0.505 |
| 123.0642 | 8916 | 8623 | 2.21 |
| 123.0697 | 5861 | 5698 | 1.52 |
| 123.0752 | 2345 | 2247 | 1.45 |
| 123.0806 | 957 | 945 | 0.229 |
| 123.0861 | 585 | 587 | 0.058 |
| | V. LITTLE, NO | | |
| 103.0308 | 4 | 9 | 1.39 |
| 103.0358 | 10 | 10 | 0 |
| 103.0408 | 38 | 37 | 0.115 |
| 103.0458 | 79 | 85 | 0.469 |
| 103.0508 | 140 | 146 | 0.355 |
| 103.0558 | 103 | 112 | 0.614 |
| 103.0608 | 46 | 47 | 0.104 |
| 103.0658 | 8 | 22 | 1.96 |
| 103.0708 | 14 | 15 | 0.186 |
| 103.0758 | 6 | 3 | 1.0 |
| 103.0809 | 2 | 2 | 0 |
| 103.0859 | 4 | 2 | 0.816 |
| 103.0909 | 5 | 4 | 0.333 |
| 103.0959 | 2 | 3 | 0.447 |
| 103.1009 | 2 | 4 | 0.816 |
| 103.1059 | 0 | 0 | 0 |

Figure 6A:
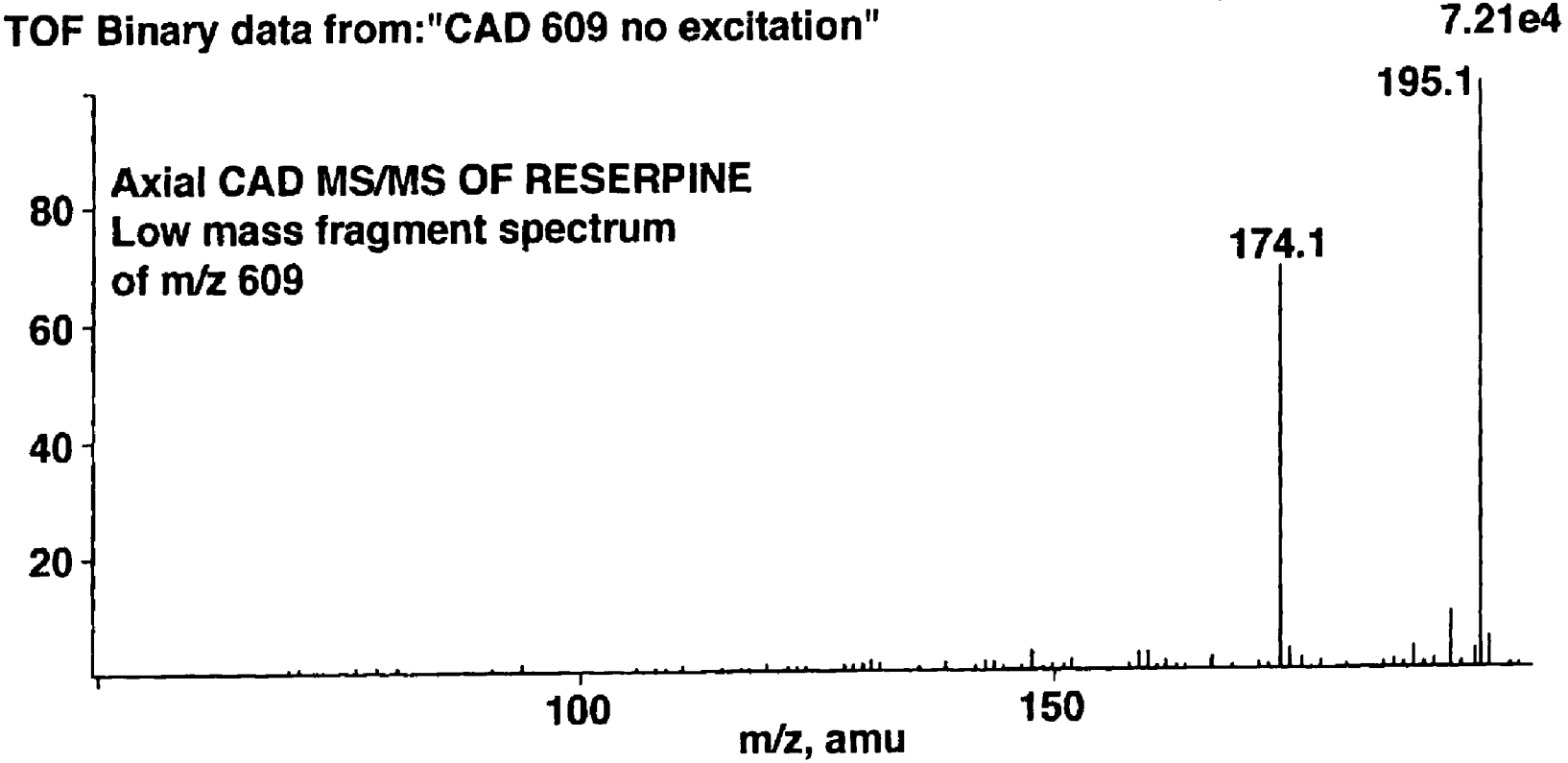

Referring now to FIGS. 6*a,* 6*b* and 6*c,* these show further spectra obtained for reserpine. FIG. 6*a* again shows just the first two MS steps, where reserpine is selected in Q1, accelerated and fragmented in Q2. Additionally, here FIG. 6*a* just shows the low mass end of the fragment spectrum up to approximately mass 200. This shows that reserpine with an m/z of 609 generates significant fragments at 174.1 and 195.1.

Figure 6B:
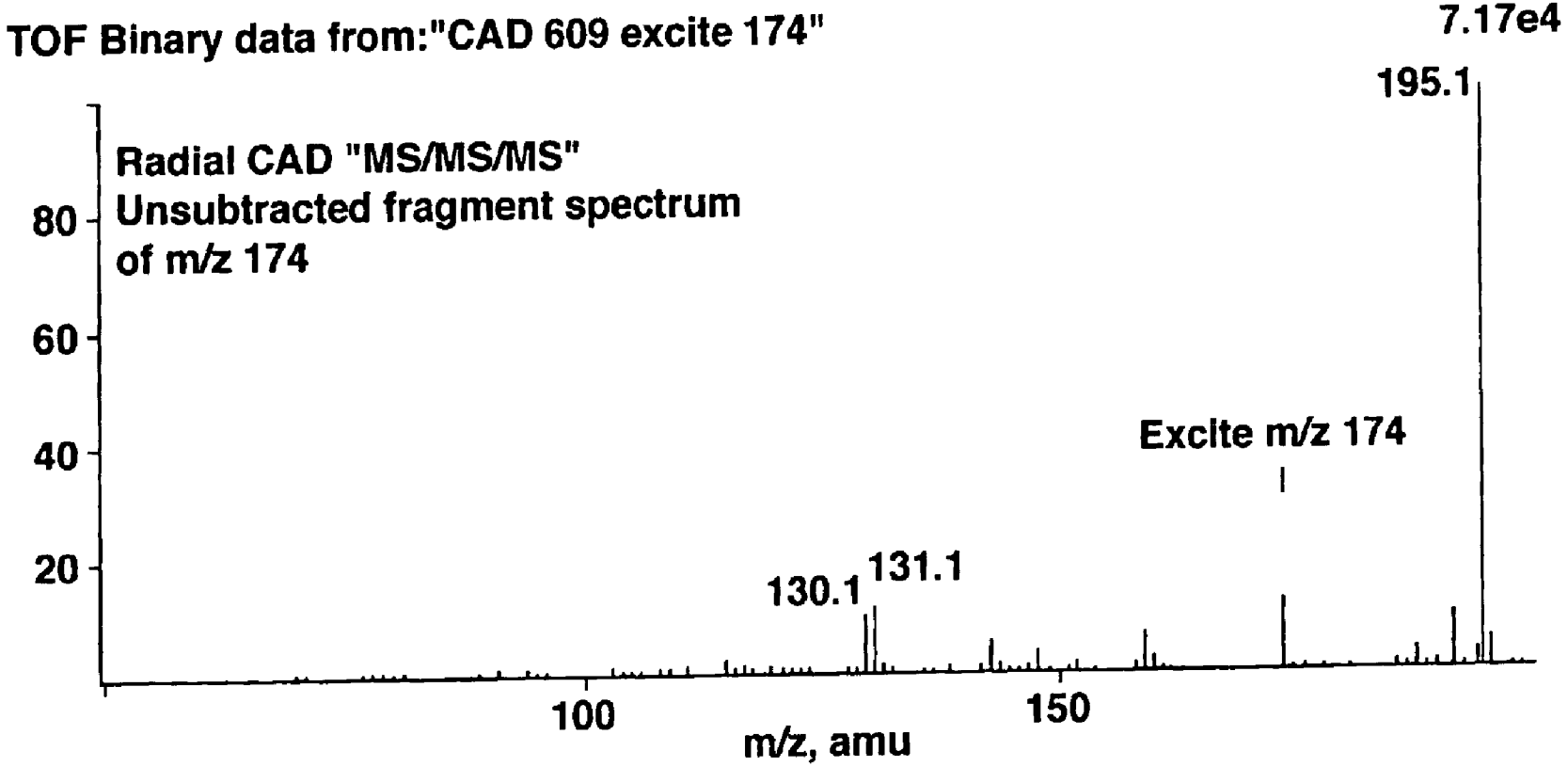

FIG. 6*b* then shows the spectrum obtain by a third MS step, where the fragment at 174 was excited. As might be expected, this shows a much reduced peak for the mass 174, and an increase in the number and intensity of fragments below mass 174, notably peaks at 130.1 and 131.1 Unlike earlier figures, FIG. 6*b* is an unsubtracted spectrum.

Figure 6C:
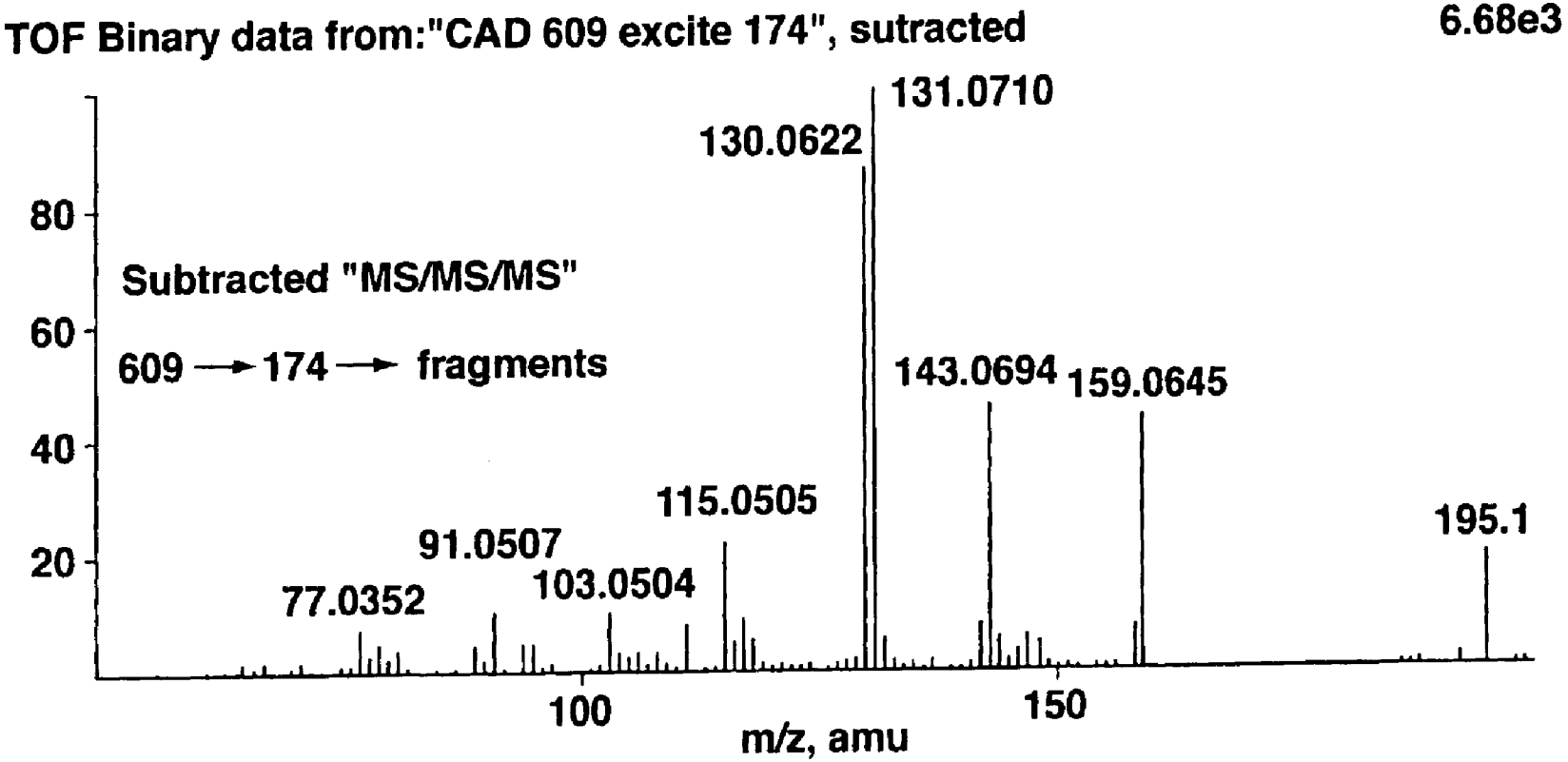

If the spectrum of FIG. 6*a* is subtracted from FIG. 6*b,* the spectra of FIG. 6*c* is obtained. Note that this is on a different scale. This clearly shows a significant reduction in the peak at 195.1, as this was present in the original spectrum of FIG. 6*a.* This spectrum also emphasizes the contribution made to the various other fragments by the third MS step, the major peaks being identified in FIG. 6*c.*

Figure 7A:
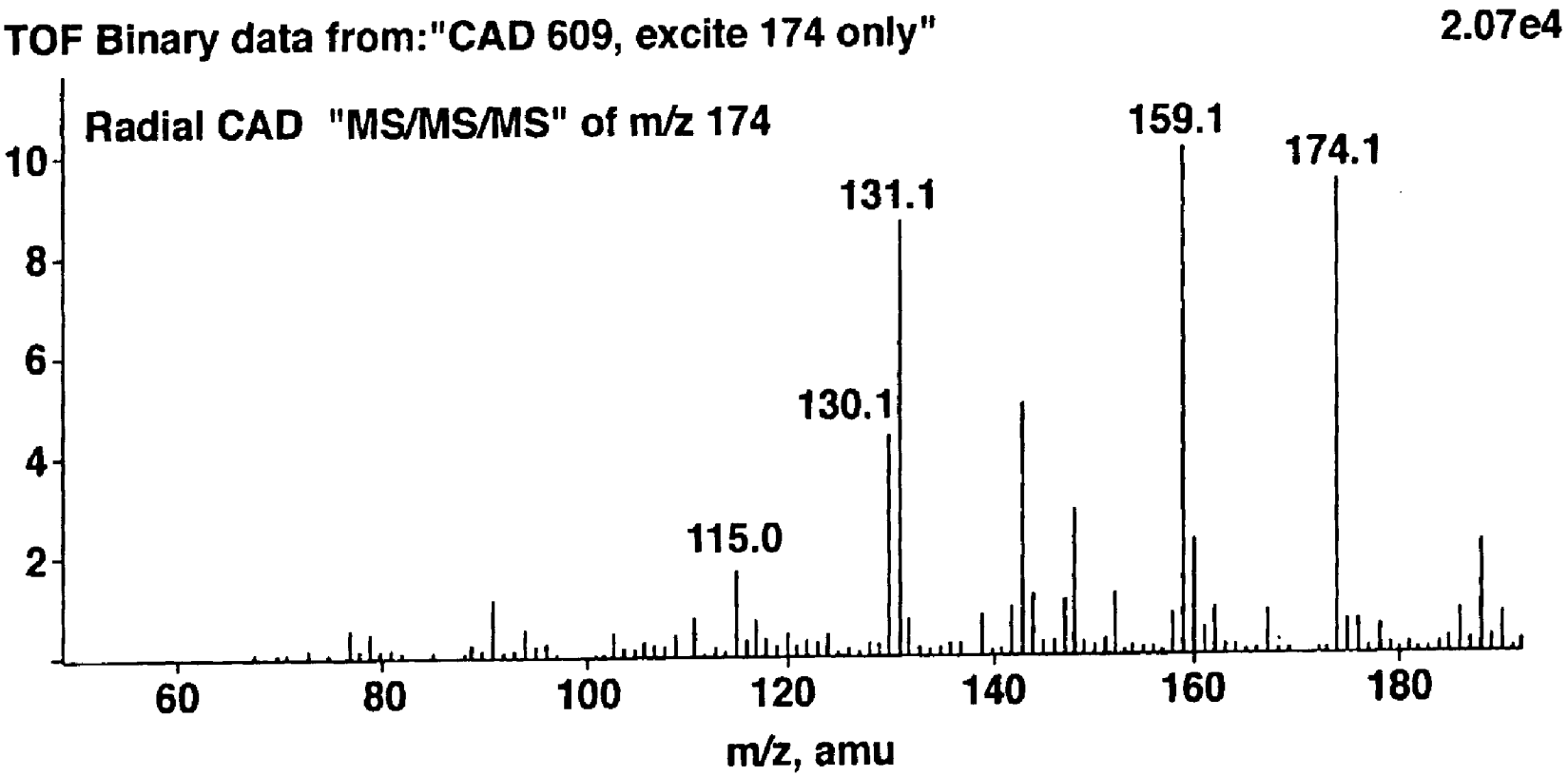

Reference will now be made to FIGS. 7*a,* 7*b* and 7*c.* FIG. 7*a* shows part of the spectrum of FIG. 6*a* but only up to a mass of approximately 190. This enables a different scale to be used, to emphasize the size of the different peaks.

Figure 7B:
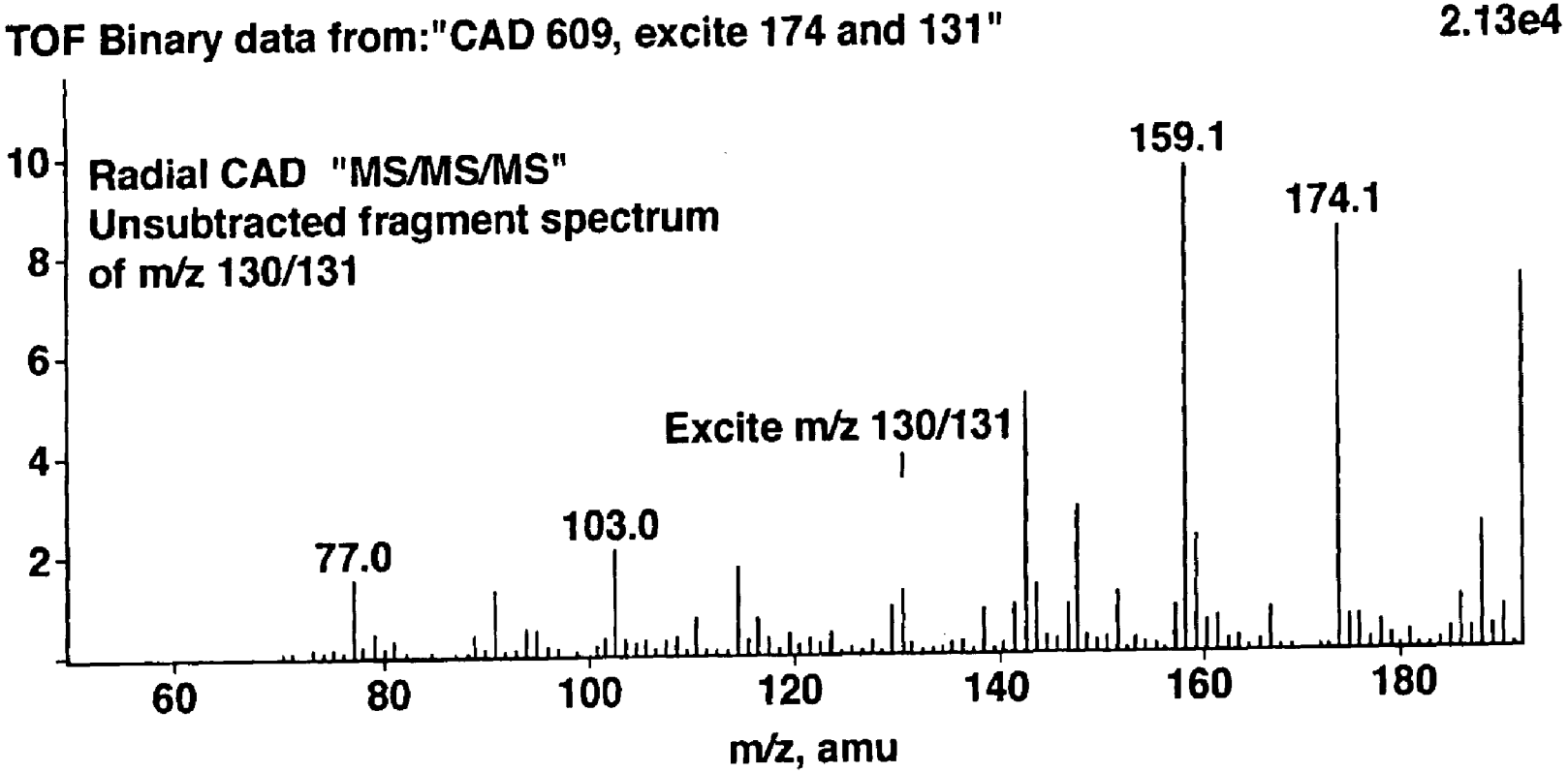

FIG. 7*b* then shows a spectrum obtained for a four-step excitation scheme. Here, the fourth MS step, $MS^4$ was effected utilizing the power supply 28 and modulation unit 30. For this scheme, the excitation as a third MS step, by the power supply 24, is continuous, without any modulation by the unit 26. The spectrum obtained is then subject to further excitation of the mass at 130/131; these two masses are so close together, that it is impossible to obtain excitation of just one mass. Again, FIG. 7*b* is an unsubtracted spectrum.

Figure 7C:
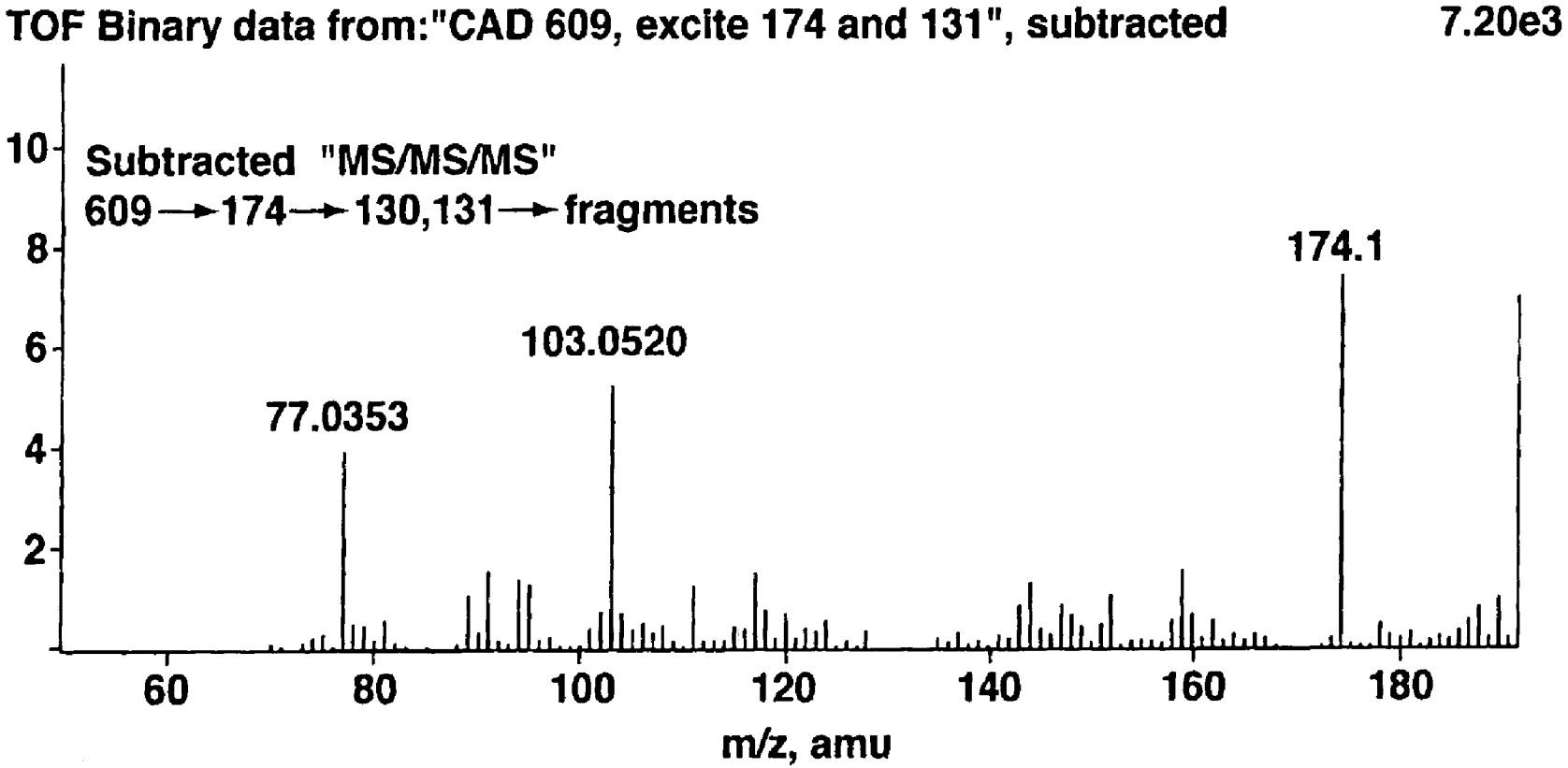

FIG. 7*c* then shows the spectrum of FIG. 7*b,* with that of FIG. 7*a* subtracted. This again, shows elimination of peaks due to previous fragmentation and hence solely the peaks resulting from ions generated by fragmentation of the ions of mass 130, 131. It should be noted that for the fourth step $MS^4$ procedure, excitation from the two power supplies 24, 28 is provided simultaneously. As noted, the power supply 24 is unmodulated, i.e. continuous, while the excitation from power supply 28 is modulated at a modulation of, for example, 2 Hz.

Figure 8A:
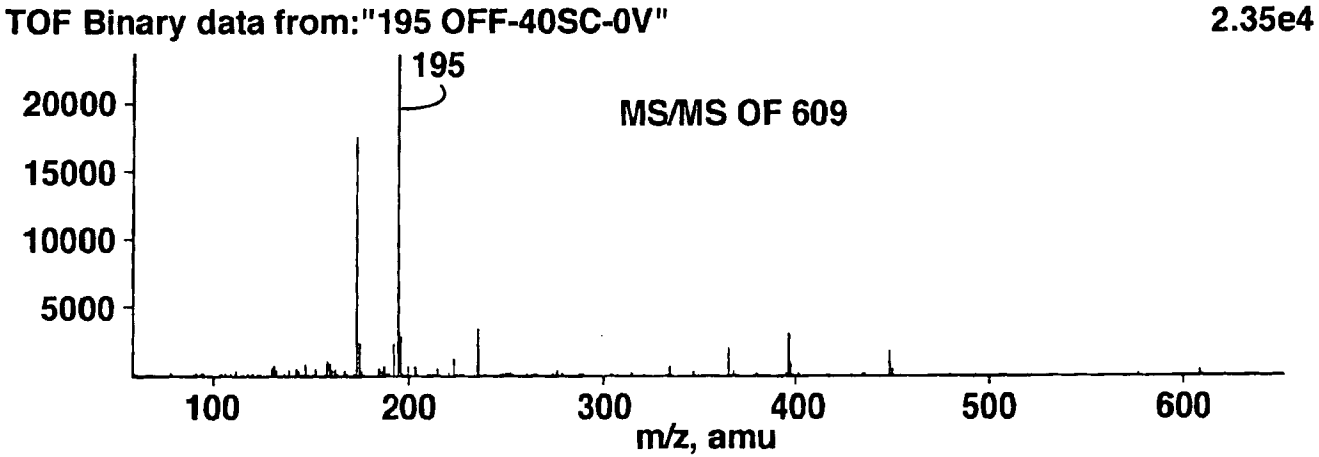
Figure 8B:
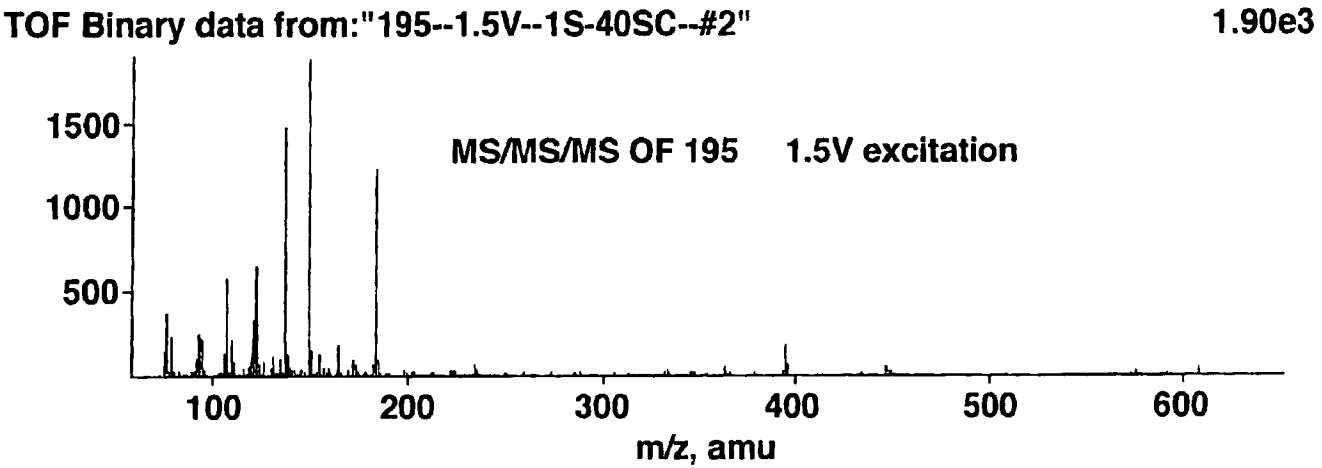
Figure 8C:
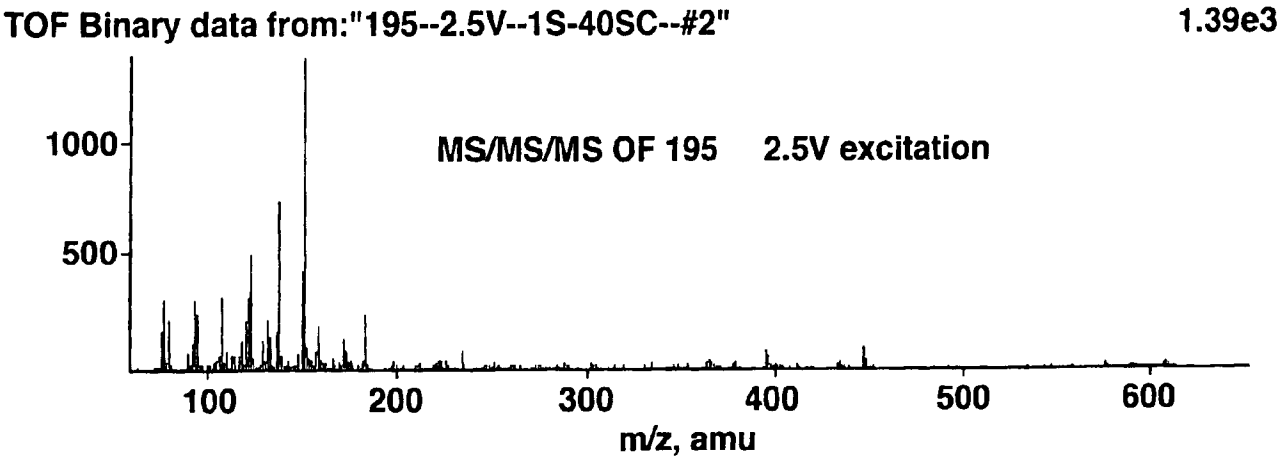
Figure 8D:
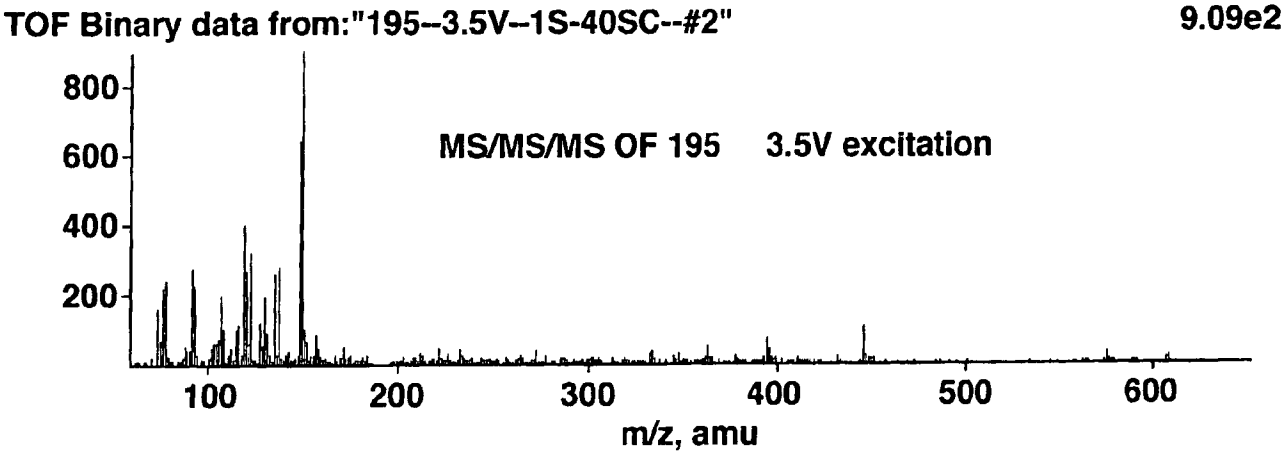

Reference will now be made to FIGS. 8*a*–8*d,* which show a series of spectra, indicating the effects of varying the excitation voltage. FIG. 8*a* again corresponds to FIG. 6*a,* and shows the fragment spectrum obtained from the initial fragmentation of the Reserpine, again showing significant peaks at 174.1 and 195.1. In this case, the larger peak at 195.1 was selected for further excitation. This was excited at a frequency of 575 kHz and at different voltages of 1.5, 2.5 and 3.5, to obtain the spectra of FIGS. 8*b,* 8*c* and 8*d.* Each of these spectra 8*b*–8*d* are subtracted spectra, that is the spectra obtained with the excitation and subsequent subtraction of the spectrum of FIG. 8*a.* They are also unfiltered.

As might be expected, the peak at 195 is largely eliminated as a result of the excitation. It can be noted that at low excitation potentials, a peak is shown with an ion close to mass 190, and this peak reduces significantly, as the excitation voltage is increased. Correspondingly, peaks with smaller fragment ions increase. This is to be expected.

It will be appreciated that, while the invention has been described as effected with a quadrupole, it can be carried out in any suitable collision cell, and in particular any collision cell where quadrupolar fields can be applied. Also, while using a quadrupole is preferable, it will be appreciated that other multipolar guides may be used.

What is claimed is:

1. A method of analyzing a substance, the method comprising:

(1) creating a continuous stream of ions in said substance and supplying the stream of ions to a mass selection device;

(2) performing a mass analysis of the stream of ions in the mass selection device to select precursor ions of a selected mass to charge ratio of interest;

(3) transmitting from said mass selection device a continuous stream of the precursor ions of the selected mass to charge ratio of interest;

(4) supplying the continuous stream of the precursor ions from the mass selection device and a collision gas to a multipole and providing an RF signal to the multipole, the multipole is operated at a higher pressure than the mass selection device and functions as a collision cell;

(5) fragmenting said precursor ions in the RF multipole by collisions with the gas molecules, in order to form primary fragment ions;

(6) supplying additional alternating current to the multipole at a frequency selected to cause resonance excitation of a desired primary fragment ion mass-to-charge ratio, whereby ions with said desired primary fragment ion mass-to-charge ratio are excited and undergo collisions with the gas molecules causing production of secondary fragment ions;

(7) modulating the alternating current signal applied in step (6) whereby periods in which said alternating current signal is applied alternate with periods in which the alternating signal is not applied; and (8) detecting the ion signal after fragmentation with a mass spectrometer and collecting one set of data for one spectrum, representative of the ion spectrum when the alternating current signal is applied and another set of data for another spectrum, representative of the ion spectrum when the alternating current signal is not applied, wherein said other spectrum can be subtracted from said one spectrum, to generate a subtracted spectrum showing the secondary fragment ions without the presence of the primary fragment ions except for any said primary fragment ions which are generated by step (6).

2. A method as claimed in claim 1, wherein said mass selection device is maintained at a pressure of $10^{-5}$ Torr, and said multipole is operated at a pressure in the range of 0.5 to 20 mTorr.

3. A method as claimed in claim 1 or 2, further including the step of processing the data sets by applying statistical analysis to reject spectra having statistically insignificant variations in the ion signal.

4. The method as claimed in claim 3, wherein the statistical analysis is implemented in a software program and performed automatically.

5. A method as claimed in claim 3, which includes subtracting said one spectrum from the other spectrum to obtain a subtracted spectrum.

6. The method as claimed in claim 4, wherein the statistical analysis is performed in real time so that spectra having statistically insignificant variations in the ion signal are not displayed.

7. A method as claimed in claim 4, which includes subtracting said one spectrum from the other spectrum to obtain a subtracted spectrum.

8. A method as claimed in claim 5, which includes, for each peak, recording a plurality of data points encompassing the peak, and calculating a significance factor equation:

$$|T| = Sig = \left| \frac{\text{detected ion signal, alternating current on} - \text{detected ion signal, alternating current off}}{\sqrt{\sigma^2 \text{ alternating current on} + \sigma^2 \text{ alternating current off}}} \right|$$

and determining from the values of |T| of the ion signal whether the detected ion signal with alternating current on created ions that significantly contributed to said peak.

9. A method as claimed in claim 6, which includes subtracting said one spectrum from the other spectrum to obtain a subtracted spectrum.

10. A method as claimed in claim 7, which includes, for each peak, recording a plurality of data points encompassing the peak, and calculating a significance factor equation:

$$|T| = Sig = \left| \frac{\text{detected ion signal, alternating current on} - \text{detected ion signal, alternating current off}}{\sqrt{\sigma^2 \text{ alternating current on} + \sigma^2 \text{ alternating current off}}} \right|$$

and determining from the values of |T| of the ion signal whether the detected ion signal with alternating current on created ions that significantly contributed to said peak.

11. A method as claimed in claim 9, which includes, for each peak, recording a plurality of data points encompassing the peak, and calculating a significance factor equation:

$$|T| = Sig = \left| \frac{\text{detected ion signal, alternating current on} - \text{detected ion signal, alternating current off}}{\sqrt{\sigma^2 \text{ alternating current on} + \sigma^2 \text{ alternating current off}}} \right|$$

and determining from the values of |T| of the ion signal whether the detected ion signal with alternating current on created ions that significantly contributed to said peak.

12. A method as claimed in claim 1 or 2, wherein, said multipole is a quadrupole.

13. A method as claimed in claim 12, which includes applying the alternating current signal at a frequency that excites the desired primary fragment ion.

14. A method as claimed in claim 1, which includes providing a potential difference between the mass selection device and the collision cell, to accelerate the precursor ions into the collision cell, wherein the precursor ions gain sufficient velocity to collide with the collision gas to cause fragmentation, and wherein step (6) comprises applying an alternating current signal to excite the desired primary fragment ions.

15. A method as claimed in claim 1 or 14, which includes applying a second alternating current signal to the multipole, to excite the secondary fragment ions generated in step (6), thereby to generate tertiary fragment ions and wherein step (7) comprises modulating the second alternating current signal.

16. A method as claimed in any one of claim 1, 2, or 14, which includes subtracting said one spectrum from the other spectrum to obtain a subtracted spectrum.

17. A method as claimed in claim 15, which includes subtracting said one spectrum from said other spectrum to obtain a subtracted spectrum.

18. A method as claimed in claim 16, which includes, for each peak, recording a plurality of data points encompassing the peak, and calculating a significance factor equation:

$$|T| = Sig = \left| \frac{\text{detected ion signal, alternating current on} - \text{detected ion signal, alternating current off}}{\sqrt{\sigma^2 \text{ alternating current on} + \sigma^2 \text{ alternating current off}}} \right|$$

and determining from the values of |T| of the ion signal whether the detected ion signal with alternating current on created ions that significantly contributed to said peak.

19. A method as claimed in claim 2 or 14, which includes applying a plurality of steps of selecting a desired fragmentation and applying an alternating current signal to generate additional fragment ions, wherein step (7) comprises modulating the last applied alternating current signal, whereby in step (8) said one spectrum includes said additional fragment ions formed by said last applied alternating current signal and said other spectrum comprises ions generated without application of said last applied alternating current signal.

20. A method as claimed in claim 1, wherein the mass selection device is a multipole.

21. A method as claimed in claim 1, wherein the mass selection device is a quadrupole.

22. An apparatus, for analyzing a substance by resonance excitation of selected ions and selective collision-induced dissociation, the apparatus comprising:

an ion source for generating a continuous stream of precursor ions;

a mass selection device for receiving the stream of ions and transmitting a continuous stream of precursor ions of a selected mass to charge ratio of interest;

a collision cell, including a multipole, for receiving the stream of precursor ions and provided with a collision gas, for collision-induced dissociation between the precursor ions and the buffer gas, the collision cell is operated at a higher pressure than the mass selection device;

a power supply connected to the multipole for generating an RF field in the multipole for guiding fragment ions produced by the collision-induced dissociation between the precursor ions and the buffer gas and for applying an additional alternating current field at a frequency selected to excite a desired ion; and a modulation means connected to the power supply, for modulating the alternating current signal, whereby periods in which said alternating current signal are applied alternate with periods in which the alternating current signal is not applied.

23. An apparatus as claimed in claim 22, which additionally includes a detector for detecting fragment ions exiting the collision cell, a switch connected to the detector, two data storage devices connected the switch, and a connection between the modulation control unit and the switch, whereby the switch switches detected data for periods when the alternating current signal is applied to one data storage device and collected data for periods when the alternating current signal is not applied to the other storage device.

24. An apparatus as claimed in claim 22, wherein the multipole is a quadrupole rod set.

25. An apparatus as claimed in claim 22 or 24, wherein the mass selection device is a quadrupole.

26. An apparatus as claimed in claim 22 or 24, wherein the mass selection device is a multipole.

27. An apparatus as claimed in claim 22, wherein said mass selection device is maintained at a pressure of $10^{-5}$ Torr, and said collision cell is maintained at a pressure in the range of 0.5 to 20 mTorr.

28. An apparatus as claimed in claim 24, which includes a second power supply connected to the quadrupole rod set, a second modulation unit connected to the second power supply and also to the switch, before applying a second alternating current signal, for excitation of a second ion.

29. An apparatus as claimed in claim 28, which includes a final mass analysis section, including the detector, for analyzing fragment ions from the collision cell.

30. An apparatus as claimed in claim 29, wherein the final mass analysis section comprises one of:

a scanning mass analyzer and a detector; and a time-of-flight device, including the detector for providing a small spectrum.

* * * * *